US010283266B2

(12) United States Patent
Nakabayashi et al.

(10) Patent No.: US 10,283,266 B2
(45) Date of Patent: May 7, 2019

(54) POWDER CORE, MANUFACTURING METHOD OF POWDER CORE, INDUCTOR INCLUDING POWDER CORE, AND ELECTRONIC/ELECTRIC DEVICE HAVING INDUCTOR MOUNTED THEREIN

(71) Applicant: Alps Electric Co., Ltd., Ota-ku, Tokyo (JP)

(72) Inventors: Ryo Nakabayashi, Niigata-ken (JP); Akinori Kojima, Niigata-ken (JP); Seiichi Abiko, Niigata-ken (JP); Keiichiro Sato, Niigata-ken (JP); Akira Sato, Niigata-ken (JP); Takao Mizushima, Niigata-ken (JP)

(73) Assignee: Alps Alpine Co., Ltd., Tokyo (JP)

( * ) Notice: Subject to any disclaimer, the term of this patent is extended or adjusted under 35 U.S.C. 154(b) by 0 days.

(21) Appl. No.: 15/472,728

(22) Filed: Mar. 29, 2017

(65) Prior Publication Data

US 2017/0309387 A1 Oct. 26, 2017

(30) Foreign Application Priority Data

Apr. 25, 2016 (JP) ..... 2016-087549

(51) Int. Cl.

| | |
|---|---|
| ***H01F 27/29*** | (2006.01) |
| ***H01F 41/02*** | (2006.01) |
| ***H01F 1/153*** | (2006.01) |
| ***H01F 1/26*** | (2006.01) |
| ***H01F 3/08*** | (2006.01) |

(Continued)

(52) U.S. Cl.

CPC ..... *H01F 41/0246* (2013.01); *H01F 1/153* (2013.01); *H01F 1/26* (2013.01); *H01F 3/08* (2013.01); *H01F 17/04* (2013.01); *H01F 17/062* (2013.01); *H01F 2017/048* (2013.01)

(58) Field of Classification Search

USPC ..... 336/192, 233, 83, 200, 232

See application file for complete search history.

(56) References Cited

U.S. PATENT DOCUMENTS

2005/0089708 A1* 4/2005 Maruko ..... C22C 45/02 428/611
2005/0236071 A1* 10/2005 Koshiba ..... H01F 1/15308 148/304

(Continued)

FOREIGN PATENT DOCUMENTS

| | | |
|---|---|---|
| CN | 104766684 A | 7/2015 |
| JP | 2006-13066 | 1/2006 |
| JP | 2006-324458 | 11/2006 |

(Continued)

OTHER PUBLICATIONS

Taiwanese Office Action from Taiwanese Application No. 106109739 dated Jul. 26, 2018.

*Primary Examiner* — Mang Tin Bik Lian
*Assistant Examiner* — Kazi S Hossain
(74) *Attorney, Agent, or Firm* — Beyer Law Group LLP

(57) ABSTRACT

A powder core includes: a powder of a crystalline magnetic material; and a powder of an amorphous magnetic material, in which a median diameter D50A of the powder of the amorphous magnetic material is 15 μm or less, and satisfies the expression: 1≤D50A/D50C≤3.5 with respect to a median diameter D50C of the powder of the crystalline magnetic material.

13 Claims, 26 Drawing Sheets

(51) Int. Cl.
*H01F 17/04* (2006.01)
*H01F 17/06* (2006.01)

(56) References Cited

U.S. PATENT DOCUMENTS

2010/0289609 A1* 11/2010 Liao ..... H01F 17/04
336/221
2013/0298730 A1* 11/2013 Ikeda ..... B22F 1/02
75/230

FOREIGN PATENT DOCUMENTS

JP 2007-134381 5/2007
JP 2010-118486 5/2010
JP 2010118486 * 5/2010
JP 2016-12715 1/2016

* cited by examiner

POWDER CORE, MANUFACTURING METHOD OF POWDER CORE, INDUCTOR INCLUDING POWDER CORE, AND ELECTRONIC/ELECTRIC DEVICE HAVING INDUCTOR MOUNTED THEREIN

CLAIM OF PRIORITY

This application claims benefit of Japanese Patent Application No. 2016-087549 filed on Apr. 25, 2016, which is hereby incorporated by reference.

BACKGROUND OF THE INVENTION

1. Field of the Invention

The present invention relates to a powder core, a manufacturing method of the powder core, an inductor including the powder core, and an electronic/electric device having the inductor mounted therein. In this specification, an "inductor" is a passive element provided with a core material including a powder core and a coil, and includes a concept of a reactor.

2. Description of the Related Art

A powder core used in an inductor of a booster circuit of a hybrid vehicle or the like, a reactor used in power generation and substation facilities, a transformer, a choke coil, and the like can be obtained by compacting a soft magnetic powder. An inductor including such a powder core is required to have both a low core loss and excellent DC superposition characteristics.

Japanese Unexamined Patent Application Publication No. 2006-13066 discloses, as means for solving the above-described problem (having both a low core loss and excellent DC superposition characteristics), an inductor having a coil integrally embedded in a core molded by pressurizing a mixed powder containing a magnetic powder and a binder mixed with each other, in which a powder obtained by mixing 5 to 20 wt % of a Sendust powder in a carbonyl iron powder is used as the magnetic powder.

In Japanese Unexamined Patent Application Publication No. 2010-118486, as an inductor capable of further reducing a core loss, an inductor provided with a magnetic core (powder core) including a solidified mixture of a mixed powder having a mixing ratio of 90 to 98 mass % of an amorphous soft magnetic powder and 2 to 10 mass % of a crystalline soft magnetic powder, and an insulating material. In the magnetic core (powder core), the amorphous soft magnetic powder is a material for lowering the core loss of the inductor, and the crystalline soft magnetic powder is regarded as a material that increases the permeability by improving the fill factor of the mixed powder and acts as a binder for binding the amorphous soft magnetic powder.

In Japanese Unexamined Patent Application Publication No. 2006-13066, a powder of different kinds of crystalline magnetic materials is used as the raw material of a powder core for the purpose of improving DC superposition characteristics, and in Japanese Unexamined Patent Application Publication No. 2010-118486, a powder of a crystalline magnetic material and a powder of an amorphous magnetic material are used as the raw material of the powder core for the purpose of a further reduction in core loss. However, in Japanese Unexamined Patent Application Publication No. 2010-118486, evaluation of DC superposition characteristics is not performed.

SUMMARY OF THE INVENTION

The present invention provides a powder core which contains a powder of a crystalline magnetic material and a powder of an amorphous magnetic material and enables an inductor including the powder core to improve DC superposition characteristics and decrease a core loss. The present invention also provides a manufacturing method of the powder core, an inductor including the powder core, and an electronic/electric device having the inductor mounted therein.

In order to solve the problems, the inventors conducted examinations and, as a result, found that it is possible to improve the DC superposition characteristics of an inductor having a powder core and reduce the core loss thereof by appropriately adjusting the particle size distribution of a powder of a crystalline magnetic material and the particle size distribution of a powder of an amorphous magnetic material contained in the powder core, and in a preferable embodiment, it is possible to nonlinearly improve the DC superposition characteristics of an inductor having a powder core and reduce the core loss thereof over a range inferred from the mixing ratio between the powder of the crystalline magnetic material and the powder of the amorphous magnetic material contained in the powder core.

The invention completed based on such inventors' own findings is as follows.

According to an aspect of the present invention, a powder core includes: a powder of a crystalline magnetic material; and a powder of an amorphous magnetic material, in which a median diameter D50A of the powder of the amorphous magnetic material is 15 μm or less, and satisfies the following expression (1) with respect to a median diameter D50C of the powder of the crystalline magnetic material.

$$1 \leq D50A/D50C \leq 3.5 \quad (1)$$

In a case where the particle size distribution of the powder of the crystalline magnetic material and the particle size distribution of the powder of the amorphous magnetic material contained in the powder core satisfy the above relationship, it is possible to nonlinearly improve the DC superposition characteristics of an inductor having a powder core and reduce the core loss thereof over a range inferred from the mixing ratio between the powder of the crystalline magnetic material and the powder of the amorphous magnetic material contained in the powder core.

There may be cases where it is preferable that the median diameter D50A of the powder of the amorphous magnetic material satisfies the following expression (2) with respect to the median diameter D50C of the powder of the crystalline magnetic material. As described later in examples, by satisfying the following expression (2), both two parameters ($\mu 0 \times \mu 5500 \times Isat/\rho$ and $\mu 0 \times Isat/\rho$, which represent the DC superposition characteristics, are likely to be satisfactory.

$$1.2 \leq D50A/D50C \leq 2.5 \quad (2)$$

There may be cases where it is preferable that the median diameter D50A of the powder of the amorphous magnetic material is 7 μm or less from the viewpoint of more stably realizing the improvement in the DC superposition characteristics of the inductor including the powder core and a reduction in the core loss thereof.

There may be cases where it is preferable that a first mixing ratio which is a mass ratio of a content of the powder of the crystalline magnetic material to a sum of the content of the powder of the crystalline magnetic material and a content of the powder of the amorphous magnetic material contained in the powder core is 40 mass % or less from the viewpoint of more stably realizing a reduction in the core loss of the inductor than an inductor including a powder core made of only the powder of the amorphous magnetic material.

The first mixing ratio may be 2 mass % or more.

The crystalline magnetic material may contain one or two or more materials selected from the group consisting of a Fe—Si—Cr alloy, a Fe—Ni alloy, a Fe—Co alloy, a Fe—V alloy, a Fe—Al alloy, a Fe—Si alloy, a Fe—Si—Al alloy, carbonyl iron, and pure iron. It is preferable that the crystalline magnetic material is made of the Fe—Si—Cr alloy.

The amorphous magnetic material may contain one or two or more materials selected from the group consisting of a Fe—Si—B alloy, a Fe—P—C alloy, and a Co—Fe—Si—B alloy. It is preferable that the amorphous magnetic material is made of the Fe—P—C alloy.

It is preferable that the powder of the crystalline magnetic material is made of a material subjected to an insulation treatment. By performing the insulation treatment, the improvement in the insulation resistance of the powder core and a reduction in the core loss thereof in a high frequency band can be more stably realized.

The powder core may further include: a binding component which binds the powder of the crystalline magnetic material and the powder of the amorphous magnetic material to other materials contained in the powder core. In this case, it is preferable that the binding component contains a component based on a resin material.

According to another aspect of the present invention, a manufacturing method of a powder core, which is a manufacturing method of the powder core, includes: a molding step of obtaining a molded product by a molding treatment including pressure molding of a mixture containing the powder of the crystalline magnetic material, the powder of the amorphous magnetic material, and a binder component based on the resin material. In the manufacturing method, more efficient manufacturing of the powder core is realized.

In the manufacturing method, the molded product obtained in the molding step may be the powder core. Otherwise, a heat treatment step of obtaining the powder core by performing a heat treatment of heating the molded product obtained in the molding step may be further included.

According to still another aspect of the present invention, an inductor includes: the powder core; a coil; and connection terminals connected to respective end portions of the coil, in which at least a part of the powder core is disposed so as to be positioned in an induced magnetic field generated by current when the current is caused to flow through the coil via the connection terminals. It is possible for the inductor to achieve both excellent DC superposition characteristics and a low loss based on the excellent characteristics of the powder core.

According to still another aspect of the present invention, an electronic/electric device has the inductor mounted therein, in which the inductor is connected to a substrate with the connection terminals. The electronic/electric device is exemplified by a power supply device including a power supply switching circuit, a voltage raising and lowering circuit, a smoothing circuit, and the like, a compact portable communication device, and the like. Since the electronic/electric device according to the present invention includes the inductor, it is easy to cope with a high current and high frequency.

In the powder core according to the aspects of the invention, since the particle size distribution of the powder of the crystalline magnetic material and the particle size distribution of the powder of the amorphous magnetic material are appropriately adjusted, it is possible for the inductor including the powder core to improve DC superposition characteristics and reduce a core loss. In addition, according to the aspects of the present invention, the manufacturing method of the powder core, the inductor including the powder core, and the electronic/electric device having the inductor mounted therein are provided.

DESCRIPTION OF THE PREFERRED EMBODIMENTS

Hereinafter, embodiments of the present invention will be described in detail.

1. Powder Core

Figure 1:
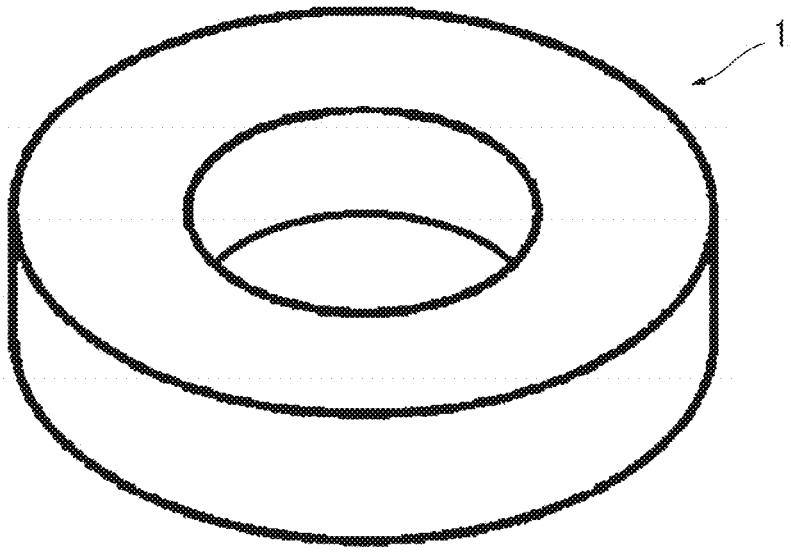
FIG. 1 is a perspective view conceptually illustrating the shape of a powder core according to an embodiment of the present invention.

A powder core 1 according to an embodiment of the present invention illustrated in FIG. 1 is a toroidal core having a ring-shaped appearance and contains a powder of a crystalline magnetic material and a powder of an amorphous magnetic material. The powder core 1 according to this embodiment is manufactured by a manufacturing method including a molding treatment including pressure molding of a mixture containing the powders. As a non-limiting example, the powder core 1 according to this embodiment contains a binding component which binds the powder of the crystalline magnetic material and the powder of the amorphous magnetic material to other materials (the same type of material or different types of materials depending on cases) contained in the powder core 1.

(1) Powder of Crystalline Magnetic Material

The specific type of a crystalline magnetic material which provides the powder of the crystalline magnetic material contained in the powder core 1 according to the embodiment of the present invention is not limited as long as it is satisfied that the material is a crystalline (able to obtain a diffraction spectrum having a clear peak to the extent that the type of the material can be specified by general X-ray diffraction measurement) and ferromagnetic, particularly, soft magnetic material. Specific examples of the crystalline magnetic material include a Fe—Si—Cr alloy, a Fe—Ni alloy, a Fe—Co alloy, a Fe—V alloy, a Fe—Al alloy, a Fe—Si alloy, a Fe—Si—Al alloy, carbonyl iron, and pure iron. The crystalline magnetic material described above may be composed of one type of material or may be composed of a plurality of types of materials. The crystalline magnetic material which provides the powder of the crystalline magnetic material is preferably one or two or more materials selected from the group consisting of the above materials, preferably contains the Fe—Si—Cr alloy among these, and is more preferably composed of the Fe—Si—Cr alloy. Since the Fe—Si—Cr alloy among the crystalline magnetic materials is a material which enables the core loss Pcv to be relatively low, even when the mass ratio (in this specification, referred to as "first mixing ratio") of the content of the powder of the crystalline magnetic material to the sum of the content of the powder of the crystalline magnetic material and the content of the powder of the amorphous magnetic material in the powder core 1 is increased, the core loss Pcv of an inductor having the powder core 1 is less likely to be increased. The content of Si and the content of Cr in the Fe—Si—Cr alloy are not limited. As a non-limiting example, the content of Si may be set to about 2 to 7 mass %, and the content of Cr may be set to about 2 to 7 mass %.

The shape of the powder of the crystalline magnetic material contained in the powder core 1 according to the embodiment of the present invention is not limited. The shape of the powder may be spherical or non-spherical. In a case of the non-spherical shape, the shape may be a shape having shape anisotropy such as a scaly shape, an ellipsoidal shape, a droplet shape, an acicular shape, or the like, or an irregular shape having no particular shape anisotropy. An example of a powder having an irregular shape includes a case where a plurality of spherical powder particles are bonded together while being in contact with each other or are bonded together while being in partially embedded in another type of powder. Such a powder having an irregular shape is easily observed in carbonyl iron.

The shape of the powder may be a shape obtained in the stage of manufacturing the powder or may be a shape obtained by secondary processing of the manufactured powder. The shape of the former is exemplified by a spherical shape, an ellipsoidal shape, a droplet shape, and an acicular shape, and the shape of the latter is exemplified by a scaly shape.

The particle size of the powder of the crystalline magnetic material contained in the powder core 1 according to the embodiment of the present invention is set by its relationship to the particle size of the powder of the amorphous magnetic material contained in the powder core 1.

There may be cases where it is preferable that the content of the powder of the crystalline magnetic material in the powder core 1 is a content such that the first mixing ratio is 40 mass % or less. When the first mixing ratio is 40 mass % or less, the core loss Pcv of the inductor having the powder core 1 is likely to be lower than that in a case where the magnetic material contained in the powder core is composed only of the amorphous magnetic material. From the viewpoint of more stably realizing a reduction of the core loss Pcv of the inductor having the powder core 1, the first mixing ratio is preferably 35 mass % or less, more preferably 30 mass % or less, and particularly preferably 25 mass % or less.

It is preferable that at least a portion of the powder of the crystalline magnetic material is made of a material subjected to a surface insulation treatment, and the powder of the crystalline magnetic material is more preferably made of the material subjected to the surface insulation treatment. In a case where the powder of the crystalline magnetic material is subjected to the surface insulation treatment, the insulation resistance of the powder core 1 tends to be improved. The type of the surface insulation treatment to be applied to the powder of the crystalline magnetic material is not limited. Examples thereof include a phosphoric acid treatment, a phosphate treatment, and an oxidation treatment.

(2) Powder of Amorphous Magnetic Material

The specific type of an amorphous magnetic material which provides the powder of the amorphous magnetic material contained in the powder core 1 according to the embodiment of the present invention is not limited as long as it is satisfied that the material is an amorphous (unable to obtain a diffraction spectrum having a clear peak to the extent that the type of the material can be specified by general X-ray diffraction measurement) and ferromagnetic, particularly, soft magnetic material. Specific examples of the amorphous magnetic material include a Fe—Si—B alloy, a Fe—P—C alloy, and a Co—Fe—Si—B alloy. The amorphous magnetic material described above may be composed of one type of material or may be composed of a plurality of types of materials. The magnetic material which forms the powder of the amorphous magnetic material is preferably one or two or more materials selected from the group consisting of the above materials, preferably contains the Fe—P—C alloy among these, and is more preferably composed of the Fe—P—C alloy.

As a specific example of the Fe—P—C alloy, there is a Fe-based amorphous alloy of which the composition formula is represented by Fe100 at %-a-b-c-x-y-z-tNiaSnbCrcPxCyBzSit, provided that 0 at %≤a≤10 at %, 0 at %≤b≤3 at %, 0 at %≤c≤6 at %, 6.8 at %≤x≤13 at %, 2.2 at %≤y≤13 at %, 0 at %≤z≤9 at %, and 0 at %≤t≤7 at %. In the above composition formula, Ni, Sn, Cr, B and Si are arbitrary additive elements.

The amount a of added Ni is preferably 0 at % or more and 6 at % or less, and more preferably 0 at % or more and 4 at % or less. The amount b of added Sn is preferably 0 at % or more and 2 at % or less, and may be added in a range of 1 at % or more to 2 at % or less. The amount c of added Cr is preferably 0 at % or more and 2 at % or less, and more preferably 1 at % or more and 2 at % or less. There may be cases where it is preferable to set the amount x of added P to 8.8 at % or more. There may be cases where it is preferable to set the amount y of added C to 5.8 at % or more and 8.8 at % or less. The amount z of added B is preferably 0 at % or more and 3 at % or less, and more preferably 0 at % or more and 2 at % or less. The amount t of added Si is preferably 0 at % or more and 6 at % or less, and more preferably 0 at % or more and 2 at % or less.

The shape of the powder of the amorphous magnetic material contained in the powder core 1 according to the embodiment of the present invention is not limited. Since the types of the shape of the powder are the same as those of the powder of the crystalline magnetic material, description thereof will be omitted. In consideration of the manufacturing method, there may be cases where it is easy to form the amorphous magnetic material into a spherical shape or ellipsoidal shape. In addition, in a generality, an amorphous magnetic material is harder than a crystalline magnetic material. Therefore, there may be cases where it is preferable to form the crystalline magnetic material in a non-spherical so as to be easily deformed during pressure molding.

The shape of the powder of the amorphous magnetic material contained in the powder core 1 according to the embodiment of the present invention may be a shape obtained in the stage of manufacturing the powder or may be a shape obtained by secondary processing of the manufactured powder. The shape of the former is exemplified by a spherical shape, an ellipsoidal shape, and an acicular shape, and the shape of the latter is exemplified by a scaly shape.

The particle size of the powder of the amorphous magnetic material contained in the powder core 1 according to the embodiment of the present invention has a particle size (also referred to as "median diameter" in this specification) D50A of 15 μm or less, which is at 50% on a cumulative particle size distribution from the small particle size side in a volume-based particle size distribution. When the median diameter D50A of the powder of the amorphous magnetic material is 15 μm or less, it is easy to reduce the core loss Pcv while improving the DC superposition characteristics of the powder core 1. From the viewpoint of more stably realizing a reduction in the core loss Pcv while improving the DC superposition characteristics of the powder core 1, the median diameter D50A of the powder of the amorphous magnetic material is preferably 10 μm or less, more preferably 7 μm or less, and particularly preferably 5 μm or less depending on cases.

The particle size of the powder of the amorphous magnetic material contained in the powder core 1 according to the embodiment of the present invention has the following relationship to the particle size of the powder of the amorphous magnetic material contained in the powder core 1. That is, the median diameter D50A of the powder of the amorphous magnetic material satisfies the following expression (1) with respect to the median diameter D50C of the powder of the crystalline magnetic material.

$$1 \leq D50A/D50C \leq 3.5 \quad (1)$$

When D50A/D50C is in a range of 1 to 3.5, it is easy to reduce the core loss Pcv while improving the DC superposition characteristics of the inductor having the powder core 1. Specifically, it is possible for the inductor having the powder core 1 to nonlinearly improve the DC superposition characteristics and reduce the core loss Pcv over a range inferred from the mixing ratio between the powder of the crystalline magnetic material contained in the powder core 1 and the powder of the amorphous magnetic material.

There may be cases where it is preferable that the median diameter D50A of the powder of the amorphous magnetic material satisfies the following expression (2) with respect to the median diameter D50C of the powder of the crystalline magnetic material. As described later in examples, by satisfying the following expression (2), both two parameters ($\mu 0 \times \mu 5500 \times Isat/\rho$ and $\mu 0 \times Isat/\rho$, which represent the DC superposition characteristics, are likely to be satisfactory.

$$1.2 \leq D50A/D50C \leq 2.5 \quad (2)$$

In comparison between an inductor having a powder core made of an amorphous magnetic material as its magnetic material and an inductor having a powder core made of a crystalline magnetic material as its magnetic material, the basic tendency is that the inductor having the powder core made of the amorphous magnetic material as its magnetic material has a low core loss Pcv but has low DC superposition characteristics. Therefore, in general, there is a tendency that the inductor having the powder core has improved DC superposition characteristics but has an increased core loss Pcv when a crystalline magnetic material is included in the magnetic material contained in the powder core and the first mixing ratio is increased from a case where the magnetic material includes only an amorphous magnetic material (a case where the first mixing ratio is 0 mass %).

However, in the inductor having the powder core 1 according to the embodiment of the present invention, the improvement in the DC superposition characteristics occurs prior an increase in the core loss Pcv, and the improvement in the DC superposition characteristics of the inductor including the powder core 1 and a reduction in the core loss Pcv can be achieved. In the powder core 1 according to a preferred embodiment of the present invention, when the first mixing ratio increases, there may be a tendency toward a reduction in the core loss Pcv of the inductor having the powder core 1 conversely. Therefore, in the powder core 1 according to the embodiment of the present invention, as long as the first mixing ratio is up to about 40 mass %, there may be cases where the DC superposition characteristics of the inductor having the powder core 1 can be improved without increasing the core loss Pcv when the crystalline magnetic material is included in the magnetic material contained in the powder core 1 and the first mixing ratio is increased from the case of only the amorphous magnetic material (the case where the first mixing ratio is 0 mass %).

From the viewpoint of more stably obtaining the preferable powder core 1, the first mixing ratio is preferably 1 mass % or more and 40 mass % or less, more preferably 2 mass % or more and 40 mass % or less, even more preferably 5 mass % or more and 40 mass % or less, and particularly preferably 5 mass % or more and 35 mass % or less depending on cases.

(3) Binding Component

The powder core 1 may contain a binding component which binds the powder of the crystalline magnetic material and the powder of the amorphous magnetic material to other materials contained in the powder core 1. The composition of the binding component is not limited as long as the binding component is a material that contributes to fixing of the powder of the crystalline magnetic material and the powder of the amorphous magnetic material contained in the powder core 1 according to this embodiment (in this specification, the powders may be collectively referred to as "magnetic powders"). Examples of the material forming the binding component include an organic material such as a resin material or pyrolysis residues of the resin material (in this specification, these are collectively referred to as "component based on a resin material"), an inorganic material, and the like. Examples of the resin material include an acrylic resin, a silicone resin, an epoxy resin, a phenol resin, a urea resin, a melamine resin, and the like. Examples of the binding component made of an inorganic material include a glass material such as water glass. The binding component may be composed of one type of material or may be composed of a plurality of materials. The binding component may be a mixture of an organic material and an inorganic material.

As the binding component, an insulating material is typically used. This makes it possible to enhance the insulating property of the powder core 1.

2. Manufacturing Method of Powder Core

The manufacturing method of the powder core 1 according to the embodiment of the present invention described above is not particularly limited. However, when the manufacturing method described below is employed, more efficient manufacturing of the powder core 1 is realized.

The manufacturing method of the powder core 1 according to the embodiment of the present invention may include a molding step described below, and may further include a heat treatment step.

(1) Molding Step

First, a mixture containing the magnetic powders, and a component that provides the binding component for the powder core 1 is prepared. The component that provides the binding component (in this specification, also referred to as "binder component") may be the binding component itself or may be a material different from the binding component depending on cases. A specific example of the latter is a case where the binder component is a resin material and the binding component is the pyrolysis residue thereof.

A molded product can be obtained by a molding treatment including pressure molding of the mixture. The pressurization conditions are not limited and are appropriately determined based on the composition of the binder component and the like. For example, in a case where the binder component is made of a thermosetting resin, it is preferable to heat the binder component under pressure to cause a curing reaction of the resin to proceed in a mold. On the other hand, in a case of compression molding, although the applied pressure is high, heating is not a necessary condition and pressurization is achieved within a short period of time.

Hereinafter, a case where the mixture is a granulated powder and is subjected to compression molding will be described in a slightly detailed manner. Since the granulated powder has excellent handling properties, the workability of the compression molding step with a short molding time and excellent productivity can be improved.

(1-1) Granulated Powder

The granulated powder contains the magnetic powders and the binder component. The content of the binder component in the granulated powder is not particularly limited. In a case where the content thereof is excessively low, the binder component hardly holds the magnetic powders. In addition, in a case where the content of the binder component is excessively low, it becomes difficult for the binding component composed of the pyrolysis residue of the binder component in the powder core 1 obtained through the heat treatment step to insulate a plurality of the magnetic powders from each other. On the other hand, in a case where the content of the binder component is excessively high, the content of the binding component contained in the powder core 1 obtained through the heat treatment step is likely to increase. When the content of the binding component in the powder core 1 increases, the magnetic properties of the powder core 1 are likely to deteriorate. Therefore, it is preferable that the content of the binder component in the granulated powder is set to a content of 0.5 mass % or more and 5.0 mass % or less in the entire granulated powder. From the viewpoint of more stably reducing the possibility of the deterioration in the magnetic properties of the powder core 1, the content of the binder component in the granulated powder is preferably set to a content of 1.0 mass % or more and 3.5 mass % or less, and more preferably a content of 1.2 mass % or more and 3.0 mass % or less in the entire granulated powder.

The granulated powder may contain materials other than the magnetic powders and the binder component. Examples of such materials include a lubricant, a silane coupling agent, an insulating filler, and the like. In a case where a lubricant is included, the type thereof is not particularly limited. The lubricant may be an organic lubricant or an inorganic lubricant. Specific examples of the organic lubricant include a metal soap such as zinc stearate and aluminium stearate. It is thought that such an organic lubricant is vaporized during the heat treatment step and hardly remains in the powder core 1.

A manufacturing method of the granulated powder is not particularly limited. The granulated powder may be obtained by kneading components which provide the granulated powder described above as they are and grinding the obtained kneaded product using a well-known method, or the granulated powder may also be obtained by preparing a slurry obtained by adding a dispersion medium (water is employed as an example) to the above-described components and drying and grinding the slurry. The particle size distribution of the granulated powder may be controlled by sifting or classification after the grinding.

Figure 2:
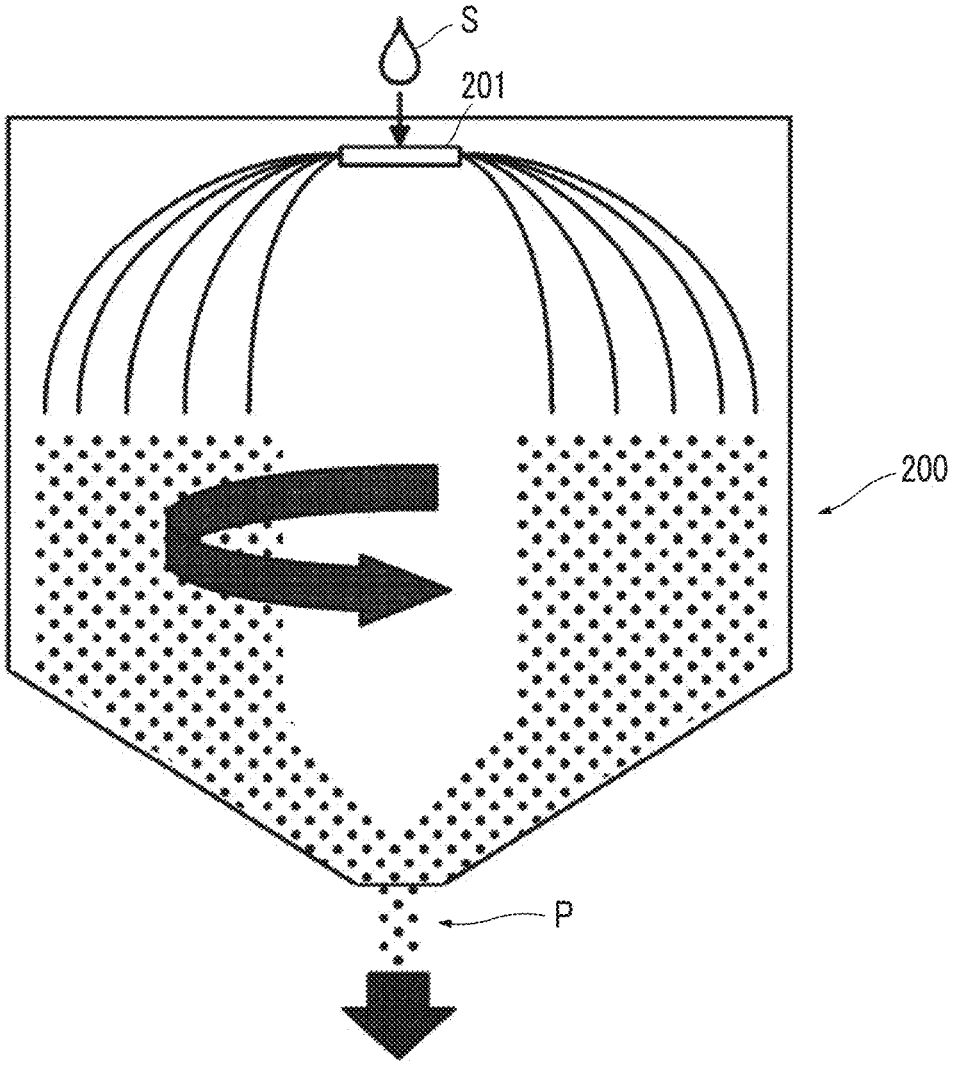
FIG. 2 is a view conceptually illustrating a spray dryer apparatus used in an example of a method of manufacturing a granulated powder and the operation thereof.

As an example of a method of obtaining the granulated powder from the slurry, a method using a spray dryer may be employed. As illustrated in FIG. 2, a rotor 201 is provided in a spray dryer apparatus 200, and a slurry S is injected from the upper part of the apparatus toward the rotor 201. The rotor 201 rotates at a predetermined rotation speed and sprays the slurry S in the form of droplets by centrifugal force in a chamber inside the spray dryer apparatus 200. Furthermore, hot air is introduced into the chamber inside the spray dryer apparatus 200, whereby the dispersion medium (water) contained in the slurry S in the form of droplets is volatilized while maintaining the form of droplets. As a result, the granulated powder P is formed from the slurry S. The granulated powder P is recovered from the lower part of the apparatus 200. Each parameter such as the rotation speed of the rotor 201, the temperature of the hot air introduced into the spray dryer apparatus 200, and the temperature of the lower part of the chamber may be set as appropriate. Specific examples of the setting ranges of these parameters include 4000 to 8000 rpm as the rotation speed of the rotor 201, 130° C. to 170° C. as the temperature of the hot air introduced into the spray dryer apparatus 200, and 80° C. to 90° C. as the temperature of the lower part of the chamber. In addition, the atmosphere in the chamber and the pressure thereof may be appropriately set. As an example, the inside of the chamber has an air atmosphere and the pressure thereof has a pressure difference of 2 mmH2O (about 0.02 kPa) from the atmospheric pressure. The particle size distribution of the obtained granulated powder P may be further controlled by sieving or the like.

(1-2) Pressurization Conditions

Pressure conditions during the compression molding are not particularly limited, and may be appropriately set in consideration of the composition of the granulated powder, the shape of the molded product, and the like. In a case where the applied pressure during the compression molding of the granulated powder is excessively low, the mechanical strength of the molded product is lowered. For this reason, problems of the deterioration in the handling properties of the molded product and a reduction in the mechanical strength of the powder core 1 obtained from the molded product are likely to be incurred. In addition, there may be cases where the magnetic properties of the powder core 1 deteriorate or the insulation properties thereof deteriorate. On the other hand, in a case where the applied pressure during the compression molding of the granulated powder is excessively high, it becomes difficult to produce a molding die that can withstand the pressure. From the viewpoint of facilitating mass production on an industrial scale by more stably reducing the possibility that the compressing and pressurizing steps adversely affect the mechanical properties and magnetic properties of the powder core 1, the applied pressure during the compression molding of the granulated powder is set to preferably 0.3 GPa or more and 2 GPa or less, more preferably 0.5 GPa or more and 2 GPa or less, and particularly preferably 0.8 GPa or more and 2 GPa or less.

During the compression molding, pressurization may be performed while heating is performed, or pressurization may be performed at room temperature.

(2) Heat Treatment Step

The molded product obtained by the molding step may be the powder core 1 according to this embodiment, or the powder core 1 may be obtained by performing the heat treatment step on the molded product as described below.

In the heat treatment step, adjustment of the magnetic properties through modification of the distance between the magnetic powders and adjustment of the magnetic properties through relieving of strain applied to the magnetic powders during the molding step are performed by heating the molded product obtained by the molding step described above, thereby obtaining the powder core 1.

Since the heat treatment step aims at adjusting the magnetic properties of the powder core 1 as described above, the heat treatment conditions such as the heat treatment temperature are set so that the magnetic properties of the powder core 1 become most favorable. As an example of a method of setting the heat treatment conditions, changing the heating temperature of the molded product while causing other conditions such as the temperature rising rate and the retention time at the heating temperature to be constant.

The evaluation criteria of the magnetic properties of the powder core 1 when the heat treatment conditions are set are not particularly limited. A specific example of evaluation items includes the core loss Pcv of the powder core 1. In this case, the heating temperature of the molded product may be set so that the core loss Pcv of the powder core 1 is minimized. Measurement conditions for the core loss Pcv are appropriately set, and as an example, conditions including a frequency of 100 kHz and a maximum execution magnetic flux density Bm of 100 mT may be employed.

The atmosphere during the heat treatment is not particularly limited. In a case of an oxidizing atmosphere, the possibility of excessive progress of pyrolysis of the binder component and the possibility of progress of oxidation of the magnetic powders are increased. Therefore, the heat treatment is preferably performed in an inert atmosphere such as nitrogen or argon or in a reducing atmosphere such as hydrogen.

3. Inductor and Electronic/Electric Device

The inductor according to the embodiment of the present invention includes the powder core 1 according to the embodiment of the present invention, a coil, and connection terminals connected to respective end portions of the coil. Here, at least a part of the powder core 1 is disposed so as to be positioned in an induced magnetic field generated by current when the current is caused to flow through the coil via the connection terminals. Since the inductor according to the embodiment of the present invention includes the powder core 1 according to the embodiment of the present invention, excellent DC superposition characteristics are achieved and the core loss is less likely to increase even at a high frequency. Therefore, a reduction in size can be achieved compared to an inductor according to the related art.

Figure 3:
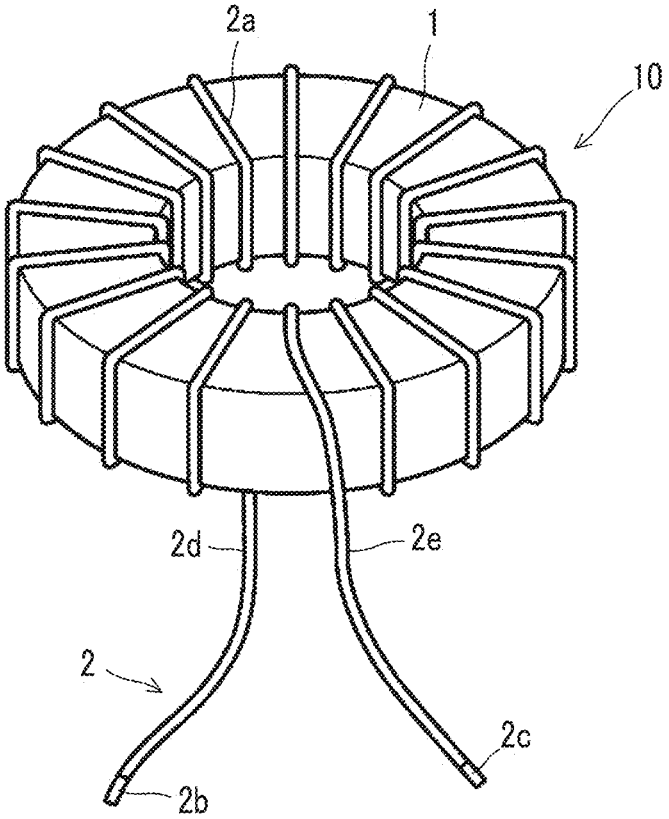
FIG. 3 is a perspective view conceptually illustrating the shape of a toroidal coil which is a type of inductor including the powder core according to the embodiment of the present invention.

An example of the inductor includes a toroidal coil 10 illustrated in FIG. 3. The toroidal coil 10 includes a coil 2*a* formed by winding a coated conductive wire 2 around the ring-shaped powder core (toroidal core) 1. End portions 2*d* and 2*e* of the coil 2*a* can be defined in portions of the conductive wire positioned between the coil 2*a* including the wound coated conductive wire 2 and the end portions 2*b* and 2*c* of the coated conductive wire 2. As described above, in the inductor according to this embodiment, the member forming the coil and the member forming the connection terminals may be formed of the same member.

Figure 4:
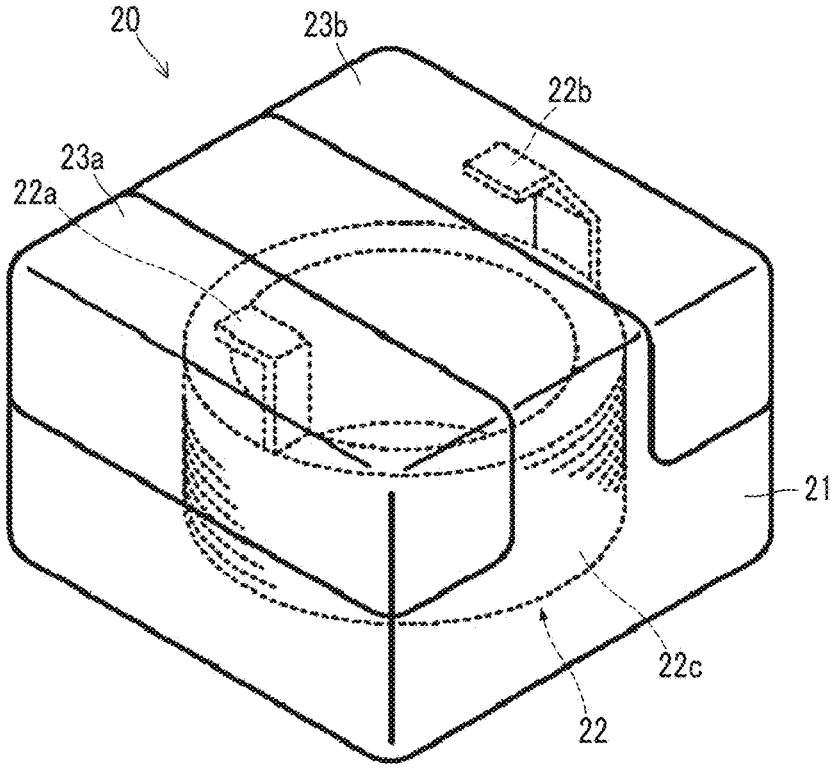
FIG. 4 is a perspective view conceptually illustrating the shape of a coil embedded type inductor which is a type of inductor including the powder core according to the embodiment of the present invention.

Another example of the inductor according to the embodiment of the present invention includes a coil embedded type inductor 20 illustrated in FIG. 4. The coil embedded type inductor 20 can be formed in a small chip shape of several mm square, and is provided with a powder core 21 having a box shape, in which a coil portion 22*c* in a coated conductive wire 22 is embedded. End portions 22*a* and 22*b* of the coated conductive wire 22 are positioned at the surface of the powder core 21 and are exposed. Portions of the surface of the powder core 21 are covered with connection end portions 23*a* and 23*b* which are electrically independent from each other. The connection end portion 23*a* is electrically connected to the end portion 22*a* of the coated conductive wire 22 and the connection end portion 23*b* is electrically connected to the end portion 22*b* of the coated conductive wire 22. In the coil embedded type inductor 20 illustrated in FIG. 4, the end portion 22*a* of the coated conductive wire 22 is covered by the connection end portion 23*a*, and the end portion 22*b* of the coated conductive wire 22 is covered by the connection end portion 23*b*.

A method of embedding the coil portion 22*c* of the coated conductive wire 22 in the powder core 21 is not limited. A member around which the coated conductive wire 22 is wound may be placed in a mold, and a mixture (granulated powder) containing the magnetic powders may be further supplied into the mold, and pressure molding may be performed thereon. Alternatively, a plurality of members preliminarily formed by molding a mixture (granulated powder) containing the magnetic powders in advance may be prepared, the members may be combined, an assembly may be obtained by disposing the coated conductive wire 22 in a void space defined at this time, and the assembly may be subjected to pressure molding. The material of the coated conductive wire 22 including the coil portion 22*c* is not limited, and for example, may be a copper alloy. The coil portion 22*c* may be an edgewise coil. The material of the connection end portions 23*a* and 23*b* are also not limited. From the viewpoint of excellent productivity, there may be cases where it is preferable that a metallized layer formed from a conductive paste such as a silver paste and a plating layer formed on the metallized layer are provided. The material forming the plating layer is not limited. Metal elements contained in the material are exemplified by copper, aluminium, zinc, nickel, iron, tin, and the like.

The electronic/electric device according to the embodiment of the present invention is an electronic/electric device in which the inductor according to the embodiment of the present invention is mounted, and is connected to a substrate with the connection terminals. Since the inductor according to the embodiment of the present invention is mounted in the electronic/electric device according to the embodiment of the present invention, even when a large current is caused to flow in the device or a high frequency is applied thereto, problems caused by the degradation of the function of the inductor or generated heat are less likely to be incurred, and a reduction in the size of the device is easily achieved.

The above-described embodiment is described to facilitate understanding of the present invention, and is not described to limit the present invention. Therefore, each element disclosed in the embodiment includes all design changes and equivalents belonging to the technical scope of the present invention.

EMBODIMENTS

Hereinafter, the present invention will be described in more detail with reference to examples and the like, but the scope of the present invention is not limited to the examples and the like.

Example 1

Production of Fe-Based Amorphous Alloy Powder

Raw materials were weighed so as to achieve a composition of Fe71 at % Ni6 at % Cr2 at % P11 at % C8 at % B2 at %, and powders of five types of amorphous magnetic material (amorphous powders) having different particle size distributions were produced using a water atomization method. The particle size distributions of the powders of the obtained amorphous magnetic materials were measured as volume-based distributions using "Microtrac particle size distribution measuring apparatus MT3300EX" manufactured by Nikkiso Co., Ltd. The particle size (median diameter) D50A at 50% on a cumulative particle size distribution from the small particle size side in the volume-based particle size distribution was 5 μm. In addition, as a powder of a crystalline magnetic material, a powder which is made of a Fe—Si—Cr alloy, specifically, an alloy having a Si content of 6.4 mass % and a Cr content of 3.1 mass % and including Fe and impurities as the remainder, and has a median diameter D50C of 2 μm was prepared.

(2) Production of Granulated Powder

The powder of the amorphous magnetic material and the powder of the crystalline magnetic material were mixed to achieve the first mixing ratio shown in Table 1 such that magnetic powders were obtained. 97.2 parts by mass of the magnetic powders, 2 to 3 parts by mass of an insulating binding material made of an acrylic resin and a phenol resin, and 0 to 0.5 parts by mass of a lubricant made of zinc stearate were mixed in water as a solvent such that a slurry was obtained.

The obtained slurry was granulated under the above-described conditions using the spray dryer apparatus 200 illustrated in FIG. 2 such that a granulated powder was obtained.

(3) Compression Molding

The obtained granulated powder was supplied into a mold and was subjected to pressure molding at a surface pressure of 0.5 to 1.5 GPa such that a compact having a ring shape with an outer diameter of 20 mm, an inner diameter of 12 mm, and a thickness of 3 mm was obtained.

(4) Heat Treatment

The obtained compact was placed in a furnace in a nitrogen gas flowing atmosphere, was heated to increase the temperature in the furnace from room temperature (23° C.) to an optimal core heat treatment temperature of 200° C. to 400° C. at a temperature rising rate of 10° C./min, and was held at this temperature for 1 hour. Thereafter, a heat treatment for cooling to room temperature was performed in the furnace such that a toroidal core made of a powder core was obtained.

TABLE 1

| | First mixing ratio (mass %) | Core density ρ (g/cc) | μ0 (100 kHz) | μ5500 (100 kHz) | Isat(A) ΔL/L = 30% | Pcv(kW/m3) at 2 MHz, 15 mT |
|---|---|---|---|---|---|---|
| Example 1-1 | 0 | 5.406 | 28.49 | 22.99 | 11.4 | 154 |
| Example 1-2 | 10 | 5.523 | 28.34 | 24.32 | 13.4 | 125 |
| Example 1-3 | 20 | 5.637 | 29.28 | 25.28 | 14.4 | 127 |
| Example 1-4 | 30 | 5.697 | 29.03 | 25.94 | 16.0 | 150 |
| Example 1-5 | 40 | 5.697 | 28.48 | 25.55 | 17.0 | 155 |
| Example 1-6 | 100 | 5.619 | 21.89 | 20.56 | 24.4 | 441 |

Test Example 1: Measurement of Core Density ρ

The dimensions and weight of the toroidal cores produced in Example 1 were measured, and the density ρ (unit: g/cc) of each toroidal core was calculated from these numerical values. The results are shown in Table 1.

Test Example 2: Measurement of Magnetic Permeability

For a toroidal coil obtained by winding a coated copper wire around the toroidal core produced in Example 1 40 times on the primary side and 10 times on the secondary side, the initial permeability μ0 thereof was measured under the condition of a frequency of 100 kHz using an impedance analyzer ("4192A" manufactured by Agilent Technologies). Moreover, DC currents were superimposed on the toroidal coil under the condition of 100 kHz, and the relative magnetic permeability μ5500 when the DC applied magnetic field due to the superposition was 5500 A/m was measured. The results are shown in Table 1.

Test Example 3: Measurement of DC Superposition Characteristics

Using the toroidal coil formed from the toroidal core produced in Example 1, DC currents were superimposed on the toroidal coil based on JIS C 2560-2. Depending on the applied current value Isat (unit: A) when the ratio (ΔL/L0) of a change ΔL in an inductance L to the value L0 of the inductance L before application of the superimposed currents (initial) reached 30%, the DC superposition characteristics were evaluated. Measurement of the DC superposition characteristics was performed using "4284" manufactured by Agilent Technologies. The results are shown in Table 1.

Test Example 4: Measurement of Core Loss Pcv

For the toroidal coil obtained by winding a coated copper wire around the toroidal core produced in Example 1 15 times on the primary side and 10 times on the secondary side, the core loss Pcv (unit: kW/m3) thereof was measured at a measurement frequency of 2 MHz under the condition of an effective maximum magnetic flux density Bm of 15 mT using a BH analyzer ("SY-8217" manufactured by Iwatsu Electric Co., Ltd.). The results are shown in Table 1.

Evaluation Example 1: Relative Pcv

Regarding the core loss Pcv measured in Test Example 4, a value normalized by a case where the first mixing ratio was 0 mass % was evaluated as Relative Pcv. By Relative Pcv, even when the types of the crystalline magnetic material and the amorphous magnetic material contained in the powder core (toroidal core) are different from each other, the degree of the change in the core loss Pcv due to the change in the first mixing ratio can be relatively evaluated. The evaluation results are shown in Table 2.

Evaluation Example 2: μ0×μ5500×Isat/ρ

μ0×μ5500×Isat/ρ, which is the numerical part of the product of the initial permeability μ0 measured in Test Example 2, the relative permeability μ5500 when the DC applied magnetic field is 5500 A/m, and Isat/ρ (a value obtained by dividing the applied current value Isat when ΔL/L0 is 30% by the core density ρ measured in Test Example 1) based on the results measured in Test Examples 1 and 3 is more suitable for the relative evaluation of DC superposition characteristics than Isat. The evaluation results are shown in Table 2.

While μ0 and μ5500 are values normalized by volume, Isat is a value that is not normalized by volume or mass and is accordingly affected by the size of the powder core (toroidal core). Therefore, by using a parameter including Isat/ρ obtained by dividing Isat by ρ as an evaluation object, the DC superposition characteristics are generalized and can be easily compared.

Evaluation Example 3: μ0×Isat/ρ

μ0×Isat/ρ, which is the numerical part of the product of the initial permeability μ0 measured in Test Example 2 and Isat/ρ based on the results measured in Test Examples 1 and 3 is more suitable for the relative evaluation of DC superposition characteristics than Isat like μ0×μ5500×Isat/ρ. The evaluation results are shown in Table 2.

TABLE 2

| | Relative Pcv | μ0 × μ5500 × Isat/ρ | μ0 × Isat/ρ |
|---|---|---|---|
| Example 1-1 | 1.00 | 1382 | 60.1 |
| Example 1-2 | 0.81 | 1673 | 68.8 |
| Example 1-3 | 0.82 | 1891 | 74.8 |
| Example 1-4 | 0.98 | 2115 | 81.5 |
| Example 1-5 | 1.00 | 2171 | 85.0 |
| Example 1-6 | 2.87 | 1954 | 95.0 |

Examples 2 to 10

As shown in Table 3, using magnetic powders in which the particle size of a powder of an amorphous magnetic material, the composition of a powder of a crystalline magnetic material, a surface treatment, and a particle size are different from those of the magnetic powders used in Example 1, toroidal cores including powder cores were obtained in the same manner as in Example 1. In addition, the powder of the amorphous magnetic material used in Example 10 was produced by an atomization method in which gas atomization and water atomization are continuously performed. The column of D50C in Table 3 displays the particle size (median diameter, unit: μm) which is at 50% on a cumulative particle size distribution from the small particle size side in a volume-based particle size distribution obtained by measuring the particle size distribution of the powder of the crystalline magnetic material as a volume based distribution using "Microtrac particle size distribution measuring apparatus MT3300EX" manufactured by Nikkiso Co., Ltd.

TABLE 3

| | Powder of amorphous magnetic material D50A(μm) | Powder of crystalline magnetic material | | | |
|---|---|---|---|---|---|
| | | Composition type | D50C(μm) | Surface treatment type | D50A/D50C |
| Example 1 | 5 | A-1 | 2 | I | 2.5 |
| Example 2 | 7 | A-1 | 2 | I | 3.5 |
| Example 3 | 5 | A-1 | 2 | II | 2.5 |
| Example 4 | 5 | B-1 | 2 | I | 2.5 |
| Example 5 | 5 | B-2 | 4 | I | 1.3 |
| Example 6 | 5 | B-2 | 4 | II | 1.3 |
| Example 7 | 7 | B-2 | 4 | II | 1.8 |
| Example 8 | 5 | A-2 | 5 | I | 1.0 |
| Example 9 | 5 | C | 4.3 | III | 1.2 |
| Example 10 | 15 | B-2 | 4 | II | 3.8 |

The meanings of the symbols in Table 3 are as follows.

Composition Type

A-1: Fe—Si—Cr alloy (the same composition as in Example 1) having a Si content of 6.4 mass % and a Cr content of 3.1 mass % and including Fe and unavoidable impurities as the remainder A-2: Fe—Si—Cr alloy having a Si content of 6.3 mass % and a Cr content of 3.2 mass % and including Fe and unavoidable impurities as the remainder B-1: Fe—Si—Cr alloy having a Si content of 2.0 mass % and a Cr content of 3.5 mass % and including Fe and unavoidable impurities as the remainder B-2: Fe—Si—Cr alloy having a Si content of 3.5 mass % and a Cr content of 4.5 mass % and including Fe and unavoidable impurities as the remainder C: Carbonyl iron Surface Treatment Type I: No surface treatment (same as in Example 1)

II: With surface insulation treatment based on zinc phosphate

III: Surface insulation treatment including phosphorylation

For Examples 2 to 10, the results of the test examples are shown in Tables 4 to 12, and the results of the evaluation examples are shown in Tables 13 to 21. In the tables, for cases where the first mixing ratio is 0 mass % and 100 mass %, from the viewpoint of improving ease of viewing of the tables, the same results are denoted by the numbers of different examples (Example 2-3, Example 3-1, and the like).

TABLE 4

| | First mixing ratio (mass %) | Core density ρ (g/cc) | μ0 (100 kHz) | μ5500 (100 kHz) | Isat(A) ΔL/L = 30% | Pcv(kW/m3) at 2 MHz, 15 mT |
|---|---|---|---|---|---|---|
| Example 2-1 | 0 | 5.480 | 30.36 | 24.17 | 10.9 | 147 |
| Example 2-2 | 30 | 5.742 | 32.58 | 27.57 | 13.8 | 159 |
| Example 2-3 | 100 | 5.619 | 21.89 | 20.56 | 24.4 | 441 |

TABLE 5

| | First mixing ratio (mass %) | Core density ρ (g/cc) | μ0 (100 kHz) | μ5500 (100 kHz) | Isat(A) ΔL/L = 30% | Pcv(kW/m3) at 2 MHz, 15 mT |
|---|---|---|---|---|---|---|
| Example 3-1 | 0 | 5.406 | 28.49 | 22.99 | 11.4 | 154 |
| Example 3-2 | 30 | 5.644 | 27.88 | 24.39 | 16.0 | 134 |
| Example 3-3 | 100 | 5.504 | 20.41 | 19.14 | 26.5 | 323 |

TABLE 6

| | First mixing ratio (mass %) | Core density ρ (g/cc) | μ0 (100 kHz) | μ5500 (100 kHz) | Isat(A) ΔL/L = 30% | Pcv(kW/m3) at 2 MHz, 15 mT |
|---|---|---|---|---|---|---|
| Example 4-1 | 0 | 5.406 | 28.49 | 22.99 | 11.4 | 154 |
| Example 4-2 | 30 | 5.814 | 30.20 | 26.68 | 16.0 | 167 |
| Example 4-3 | 40 | 5.840 | 29.52 | 26.04 | 17.5 | 250 |
| Example 4-4 | 100 | 5.894 | 23.81 | 22.22 | 27.0 | 469 |

TABLE 7

| | First mixing ratio (mass %) | Core density ρ (g/cc) | μ0 (100 kHz) | μ5500 (100 kHz) | Isat(A) ΔL/L = 30% | Pcv(kW/m3) at 2 MHz, 15 mT |
|---|---|---|---|---|---|---|
| Example 5-1 | 0 | 5.406 | 28.49 | 22.99 | 11.4 | 154 |
| Example 5-2 | 30 | 5.724 | 30.66 | 26.24 | 13.9 | 212 |
| Example 5-3 | 100 | 6.196 | 32.25 | 29.58 | 18.7 | 408 |

TABLE 8

| | First mixing ratio (mass %) | Core density ρ (g/cc) | μ0 (100 kHz) | μ5500 (100 kHz) | Isat(A) ΔL/L = 30% | Pcv(kW/m3) at 2 MHz, 15 mT |
|---|---|---|---|---|---|---|
| Example 6-1 | 0 | 5.406 | 28.49 | 22.99 | 11.4 | 154 |
| Example 6-2 | 30 | 5.722 | 29.03 | 25.67 | 15.4 | 189 |
| Example 6-3 | 100 | 6.138 | 29.83 | 27.74 | 21.1 | 393 |

TABLE 9

| | First mixing ratio (mass %) | Core density ρ (g/cc) | μ0 (100 kHz) | μ5500 (100 kHz) | Isat(A) ΔL/L = 30% | Pcv(kW/m3) at 2 MHz, 15 mT |
|---|---|---|---|---|---|---|
| Example 7-1 | 0 | 5.480 | 30.36 | 24.17 | 10.9 | 147 |
| Example 7-2 | 30 | 5.748 | 31.42 | 26.80 | 13.8 | 204 |
| Example 7-3 | 100 | 6.138 | 29.83 | 27.74 | 21.1 | 393 |

TABLE 10

| | First mixing ratio (mass %) | Core density ρ (g/cc) | μ0 (100 kHz) | μ5500 (100 kHz) | Isat(A) ΔL/L = 30% | Pcv(kW/m3) at 2 MHz, 15 mT |
|---|---|---|---|---|---|---|
| Example 8-1 | 0 | 5.406 | 28.49 | 22.99 | 11.4 | 154 |
| Example 8-2 | 10 | 5.514 | 28.66 | 24.09 | 12.7 | 140 |
| Example 8-3 | 20 | 5.621 | 29.61 | 25.53 | 13.3 | 156 |
| Example 8-4 | 30 | 5.640 | 29.18 | 25.27 | 14.4 | 195 |
| Example 8-5 | 40 | 5.699 | 29.51 | 25.53 | 14.6 | 235 |
| Example 8-6 | 100 | 5.906 | 29.92 | 26.87 | 17.5 | 373 |

TABLE 11

| | First mixing ratio (mass %) | Core density ρ (g/cc) | μ0 (100 kHz) | μ5500 (100 kHz) | Isat(A) ΔL/L = 30% | Pcv(kW/m3) at 2 MHz, 15 mT |
|---|---|---|---|---|---|---|
| Example 9-1 | 0 | 5.406 | 28.49 | 22.99 | 11.4 | 154 |
| Example 9-2 | 5 | 5.494 | 29.15 | 23.94 | 11.7 | 173 |
| Example 9-3 | 10 | 5.605 | 30.51 | 24.72 | 12.0 | 182 |
| Example 9-4 | 15 | 5.676 | 30.77 | 25.92 | 12.5 | 207 |
| Example 9-5 | 20 | 5.731 | 31.22 | 26.44 | 13.0 | 223 |
| Example 9-6 | 30 | 5.889 | 32.46 | 27.68 | 13.7 | 282 |
| Example 9-7 | 100 | 6.524 | 36.65 | 33.76 | 18.0 | 774 |

TABLE 12

| | First mixing ratio (mass %) | Core density ρ (g/cc) | μ0 (100 kHz) | μ5500 (100 kHz) | Isat(A) ΔL/L = 30% | Pcv(kW/m3) at 2 MHz, 15 mT |
|---|---|---|---|---|---|---|
| Example 10-1 | 0 | 5.401 | 43.67 | 24.42 | 5.0 | 432 |
| Example 10-2 | 30 | 5.909 | 44.49 | 31.73 | 8.5 | 283 |
| Example 10-3 | 50 | 6.024 | 38.87 | 32.23 | 12.7 | 316 |
| Example 10-4 | 70 | 6.104 | 35.36 | 31.49 | 16.0 | 347 |
| Example 10-5 | 90 | 6.138 | 32.16 | 29.39 | 19.6 | 371 |
| Example 10-6 | 100 | 6.138 | 29.83 | 27.74 | 21.1 | 393 |

TABLE 13

| | Relative Pcv | μ0 × μ5500 × Isat/ρ | μ0 × Isat/ρ |
|---|---|---|---|
| Example 2-1 | 1.00 | 1459 | 60.4 |
| Example 2-2 | 1.08 | 2159 | 78.3 |
| Example 2-3 | 3.00 | 1954 | 95.0 |

TABLE 14

| | Relative Pcv | μ0 × μ5500 × Isat/ρ | μ0 × Isat/ρ |
|---|---|---|---|
| Example 3-1 | 1.00 | 1382 | 60.1 |
| Example 3-2 | 0.87 | 1928 | 79.0 |
| Example 3-3 | 2.10 | 1881 | 98.3 |

TABLE 15

| | Relative Pcv | μ0 × μ5500 × Isat/ρ | μ0 × Isat/ρ |
|---|---|---|---|
| Example 4-1 | 1.00 | 1382 | 60.1 |
| Example 4-2 | 1.08 | 2217 | 83.1 |
| Example 4-3 | 1.63 | 2304 | 88.5 |
| Example 4-4 | 3.05 | 2423 | 109.1 |

TABLE 16

| | Relative Pcv | μ0 × μ5500 × Isat/ρ | μ0 × Isat/ρ |
|---|---|---|---|
| Example 5-1 | 1.00 | 1382 | 60.1 |
| Example 5-2 | 1.38 | 1954 | 74.5 |
| Example 5-3 | 2.65 | 2879 | 97.3 |

TABLE 17

| | Relative Pcv | μ0 × μ5500 × Isat/ρ | μ0 × Isat/ρ |
|---|---|---|---|
| Example 6-1 | 1.00 | 1382 | 60.1 |
| Example 6-2 | 1.23 | 2006 | 78.1 |
| Example 6-3 | 2.55 | 2844 | 102.5 |

TABLE 18

| | Relative Pcv | μ0 × μ5500 × Isat/ρ | μ0 × Isat/ρ |
|---|---|---|---|
| Example 7-1 | 1.00 | 1459 | 60.4 |
| Example 7-2 | 1.39 | 2022 | 75.4 |
| Example 7-3 | 2.68 | 2844 | 102.5 |

TABLE 19

| | Relative Pcv | μ0 × μ5500 × Isat/ρ | μ0 × Isat/ρ |
|---|---|---|---|
| Example 8-1 | 1.00 | 1382 | 60.1 |
| Example 8-2 | 0.91 | 1591 | 66.0 |
| Example 8-3 | 1.01 | 1788 | 70.1 |
| Example 8-4 | 1.27 | 1883 | 74.5 |
| Example 8-5 | 1.53 | 1930 | 75.6 |
| Example 8-6 | 2.42 | 2382 | 88.6 |

TABLE 20

| | Relative Pcv | μ0 × μ5500 × Isat/ρ | μ0 × Isat/ρ |
|---|---|---|---|
| Example 9-1 | 1.00 | 1382 | 60.1 |
| Example 9-2 | 1.12 | 1486 | 62.1 |
| Example 9-3 | 1.18 | 1615 | 65.3 |
| Example 9-4 | 1.34 | 1756 | 67.8 |
| Example 9-5 | 1.45 | 1873 | 70.8 |
| Example 9-6 | 1.83 | 2090 | 75.5 |
| Example 9-7 | 5.02 | 3413 | 101.1 |

TABLE 21

| | Relative Pcv | μ0 × μ5500 × Isat/ρ | μ0 × Isat/ρ |
|---|---|---|---|
| Example 10-1 | 1.00 | 987 | 40.4 |
| Example 10-2 | 0.65 | 2031 | 64.0 |
| Example 10-3 | 0.73 | 2641 | 81.9 |
| Example 10-4 | 0.80 | 2918 | 92.7 |
| Example 10-5 | 0.86 | 3019 | 102.7 |
| Example 10-6 | 0.91 | 2844 | 102.5 |

For the above results, the dependency of Relative Pcv on the first mixing ratio and the dependency of μ0×μ5500×Isat/ρ on the first mixing ratio are summarized for each example in FIGS. 5 to 24.

Figure 5:
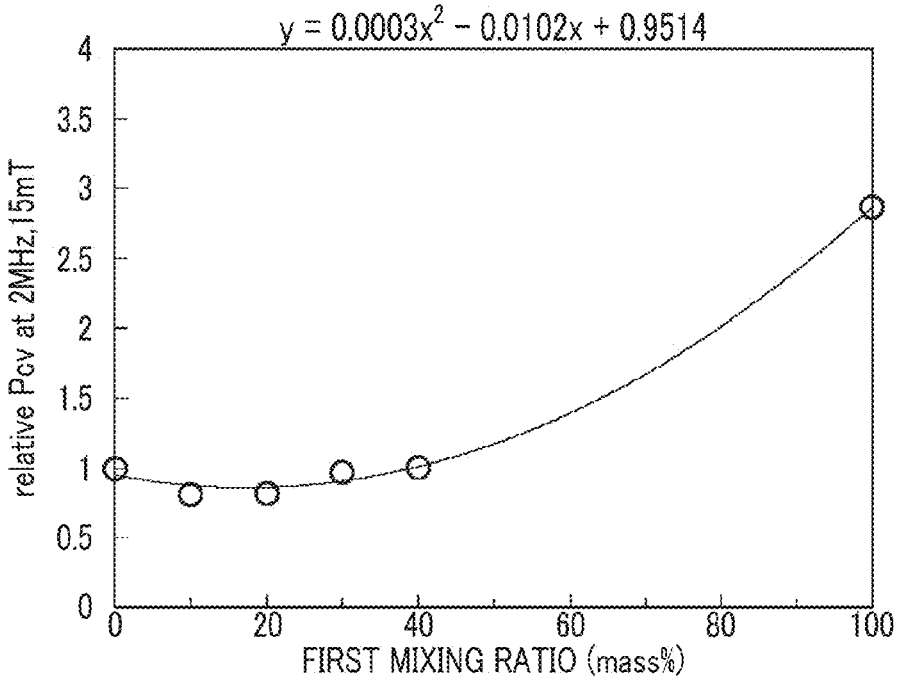
FIG. 5 is a graph showing the dependency of Relative Pcv on a first mixing ratio in Example 1.
Figure 6:
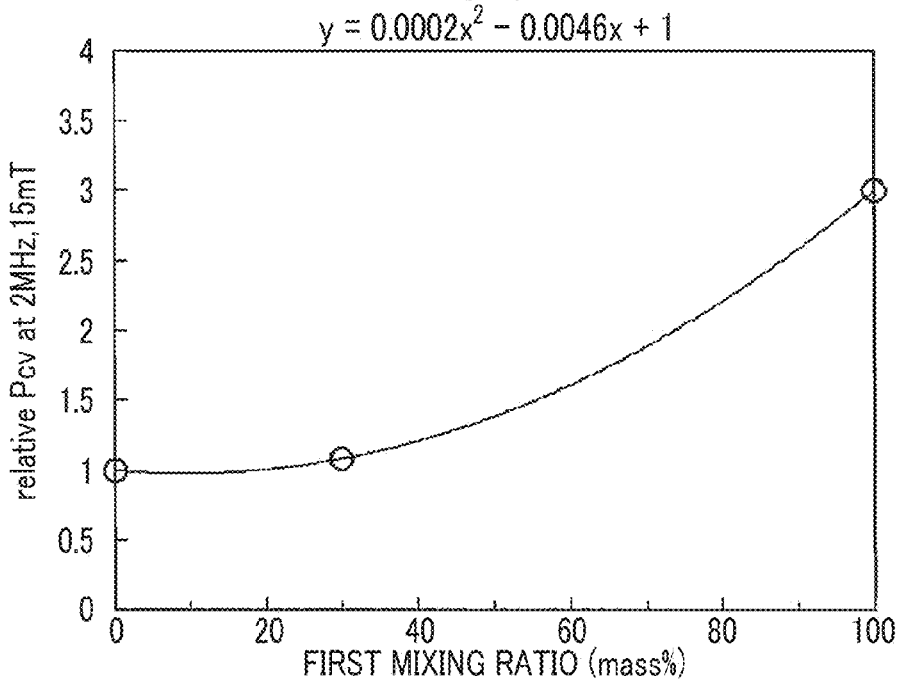
FIG. 6 is a graph showing the dependency of Relative Pcv on the first mixing ratio in Example 2.
Figure 7:
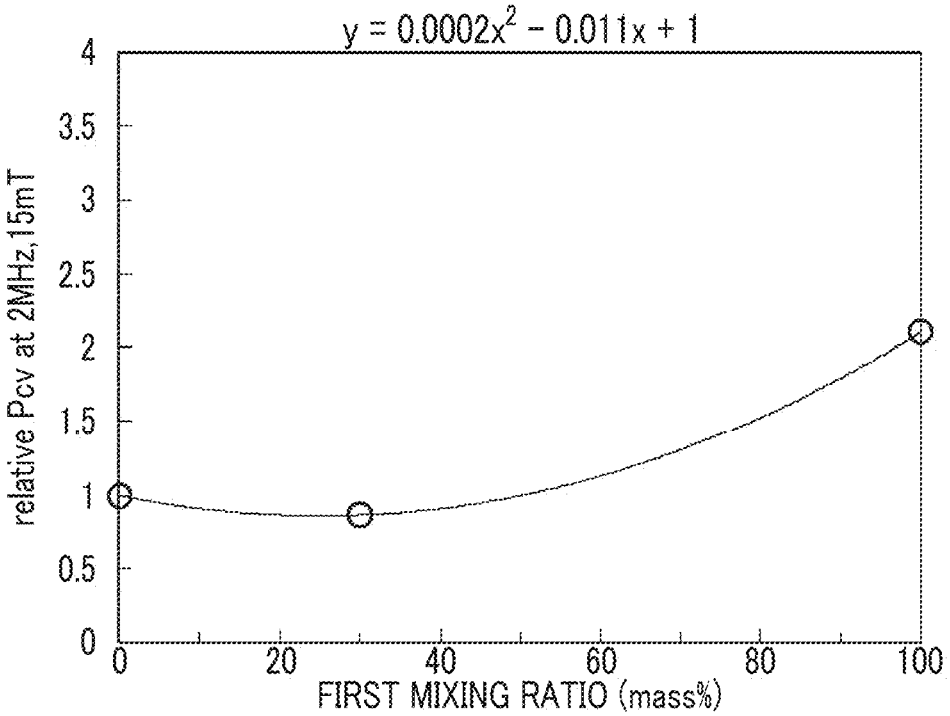
FIG. 7 is a graph showing the dependency of Relative Pcv on the first mixing ratio in Example 3.
Figure 8:
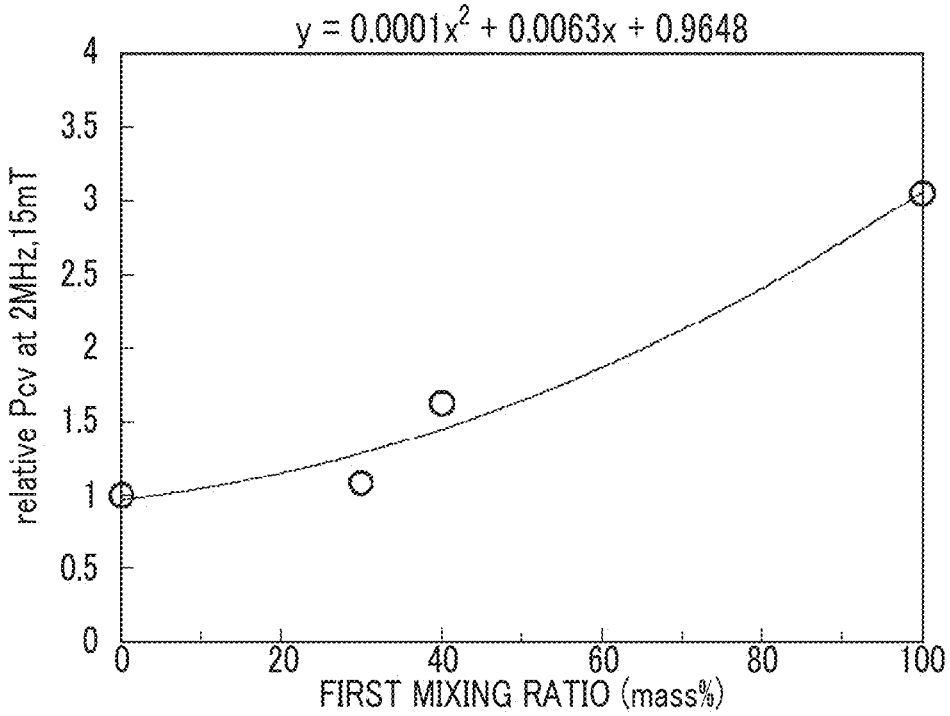
FIG. 8 is a graph showing the dependency of Relative Pcv on the first mixing ratio in Example 4.
Figure 9:
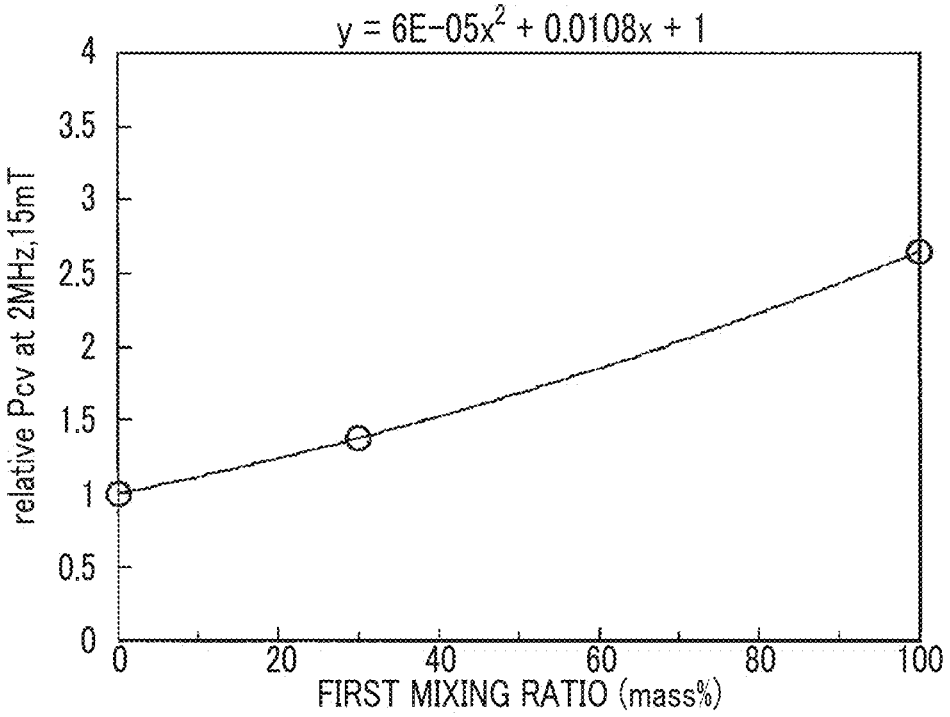
FIG. 9 is a graph showing the dependency of Relative Pcv on the first mixing ratio in Example 5.
Figure 10:
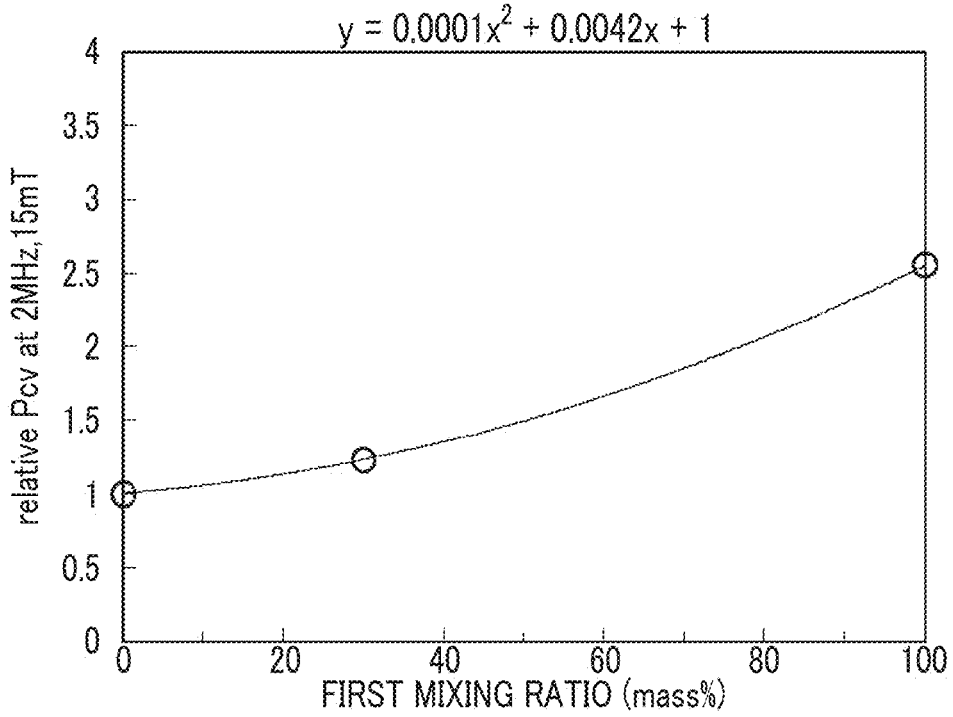
FIG. 10 is a graph showing the dependency of Relative Pcv on the first mixing ratio in Example 6.
Figure 11:
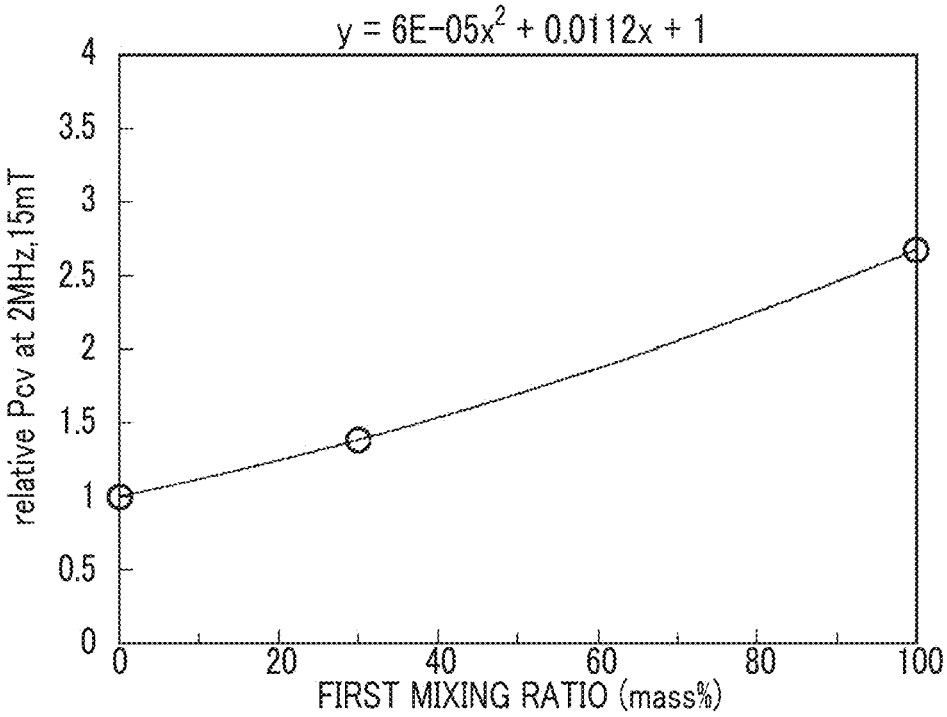
FIG. 11 is a graph showing the dependency of Relative Pcv on the first mixing ratio in Example 7.
Figure 12:
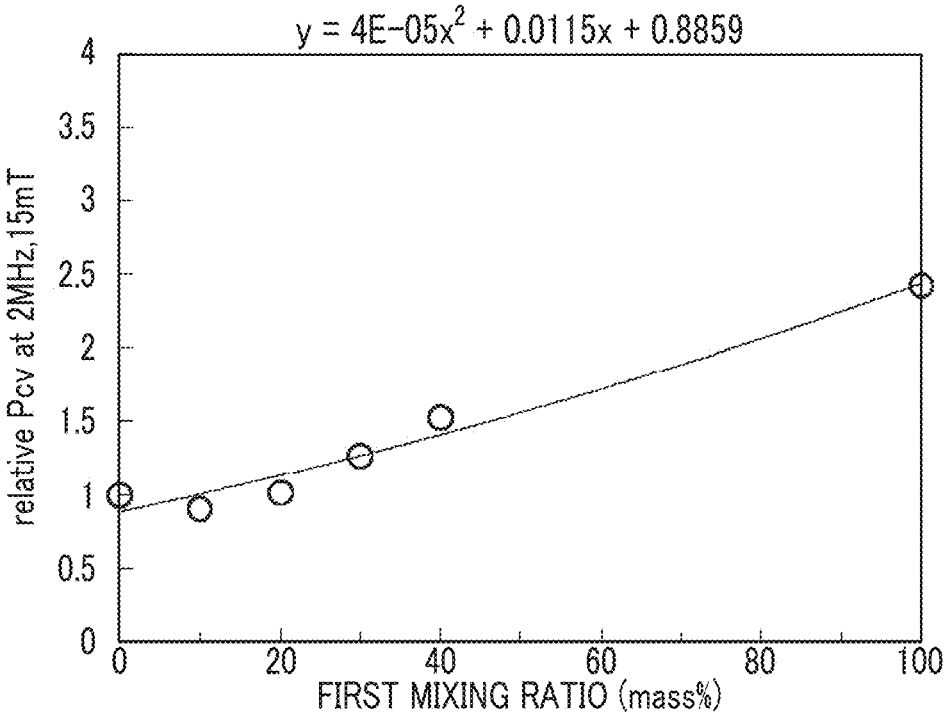
FIG. 12 is a graph showing the dependency of Relative Pcv on the first mixing ratio in Example 8.
Figure 13:
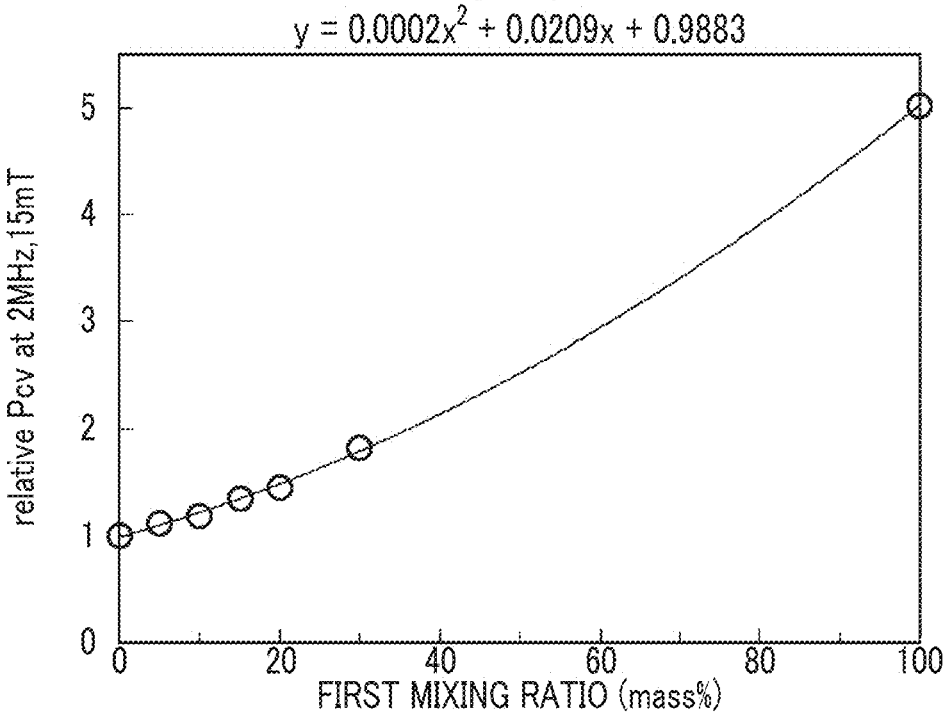
FIG. 13 is a graph showing the dependency of Relative Pcv on the first mixing ratio in Example 9.
Figure 14:
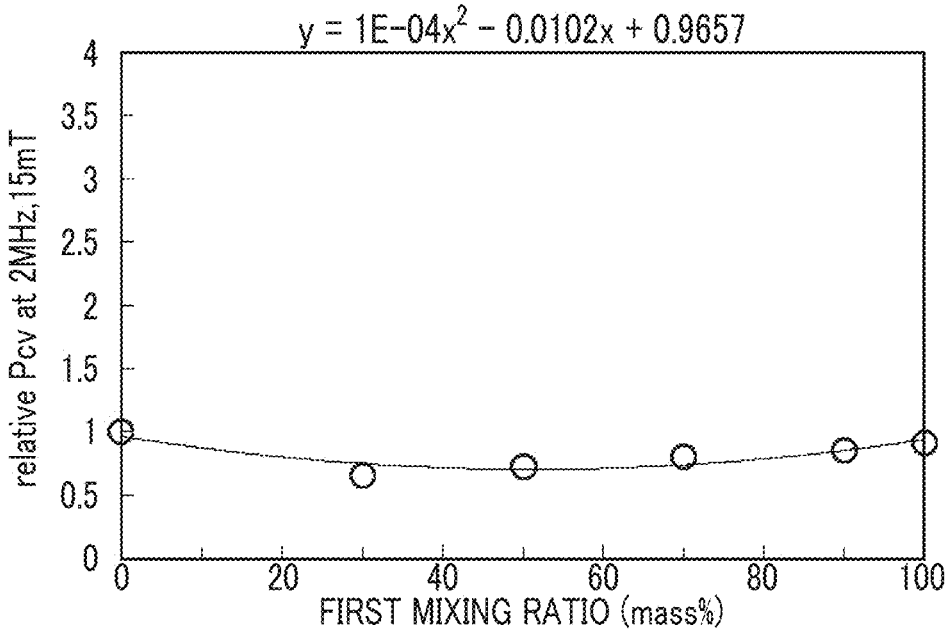
FIG. 14 is a graph showing the dependency of Relative Pcv on the first mixing ratio in Example 10.

FIG. 5 is a graph showing the dependency of Relative Pcv on the first mixing ratio in Example 1. FIG. 6 is a graph showing the dependency of Relative Pcv on the first mixing ratio in Example 2. FIG. 7 is a graph showing the dependency of Relative Pcv on the first mixing ratio in Example 3. FIG. 8 is a graph showing the dependency of Relative Pcv on the first mixing ratio in Example 4. FIG. 9 is a graph showing the dependency of Relative Pcv on the first mixing ratio in Example 5. FIG. 10 is a graph showing the dependency of Relative Pcv on the first mixing ratio in Example 6. FIG. 11 is a graph showing the dependency of Relative Pcv on the first mixing ratio in Example 7. FIG. 12 is a graph showing the dependency of Relative Pcv on the first mixing ratio in Example 8. FIG. 13 is a graph showing the dependency of Relative Pcv on the first mixing ratio in Example 9. FIG. 14 is a graph showing the dependency of Relative Pcv on the first mixing ratio in Example 10.

Figure 15:
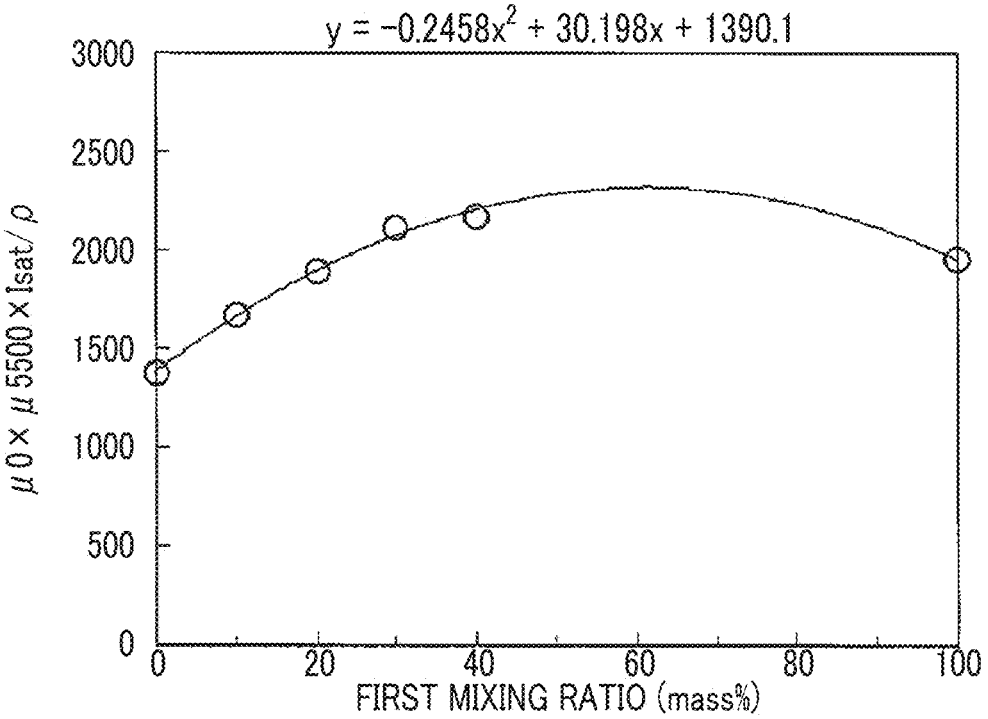
FIG. 15 is a graph showing the dependency of $\mu 0 \times \mu 5500 \times Isat/\rho$ on the first mixing ratio in Example 1.
Figure 16:
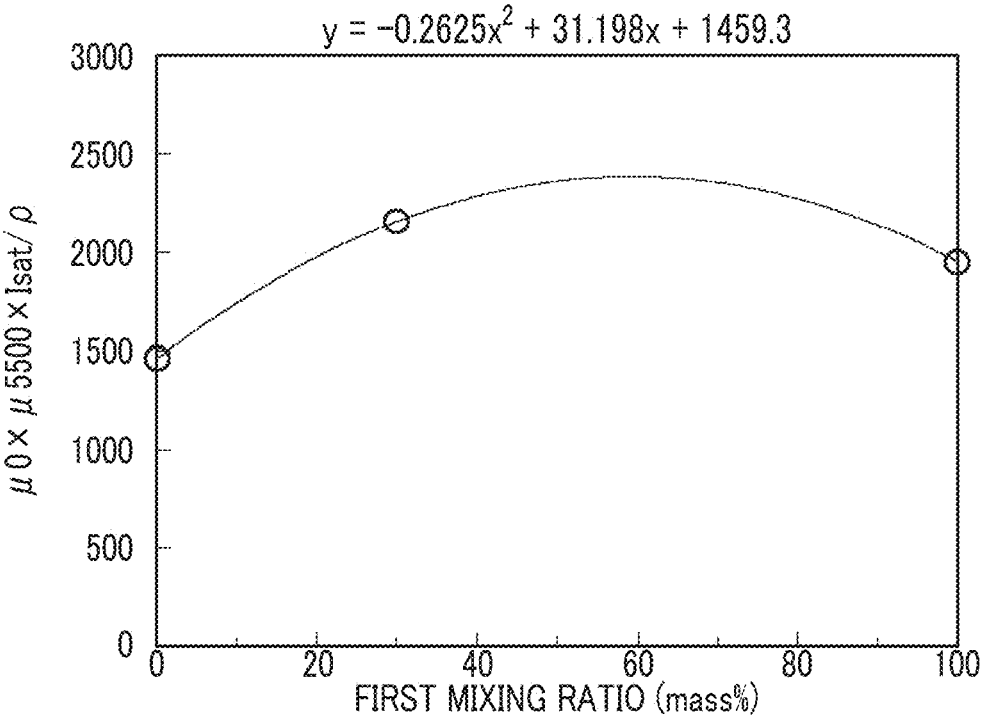
FIG. 16 is a graph showing the dependency of $\mu 0 \times \mu 5500 \times Isat/\rho$ on the first mixing ratio in Example 2.
Figure 17:
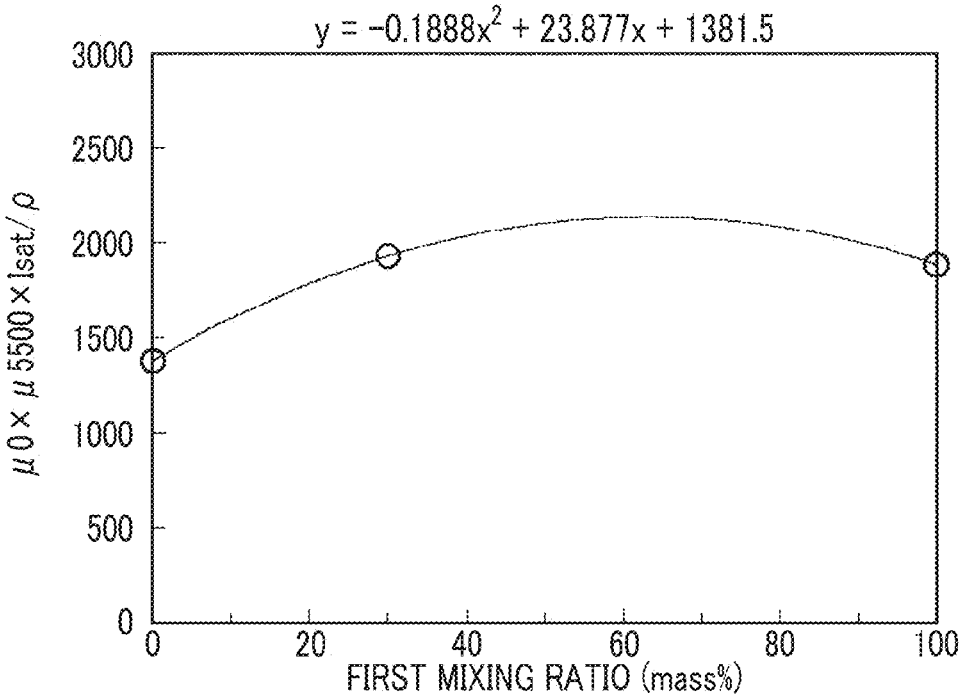
FIG. 17 is a graph showing the dependency of $\mu 0 \times \mu 5500 \times Isat/\rho$ on the first mixing ratio in Example 3.
Figure 18:
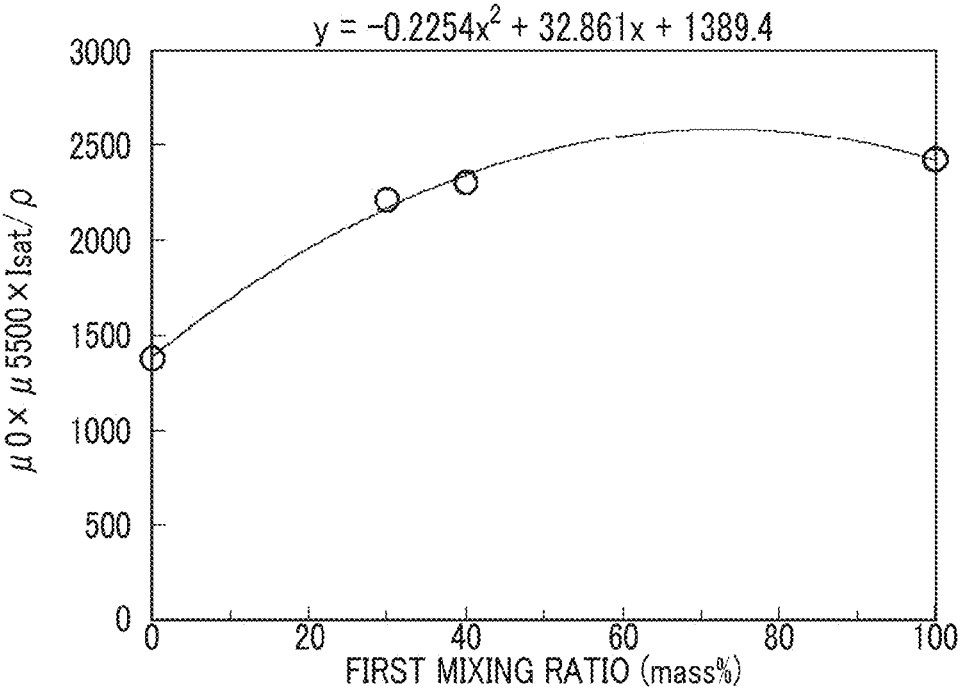
FIG. 18 is a graph showing the dependency of $\mu 0 \times \mu 5500 \times Isat/\rho$ on the first mixing ratio in Example 4.
Figure 19:
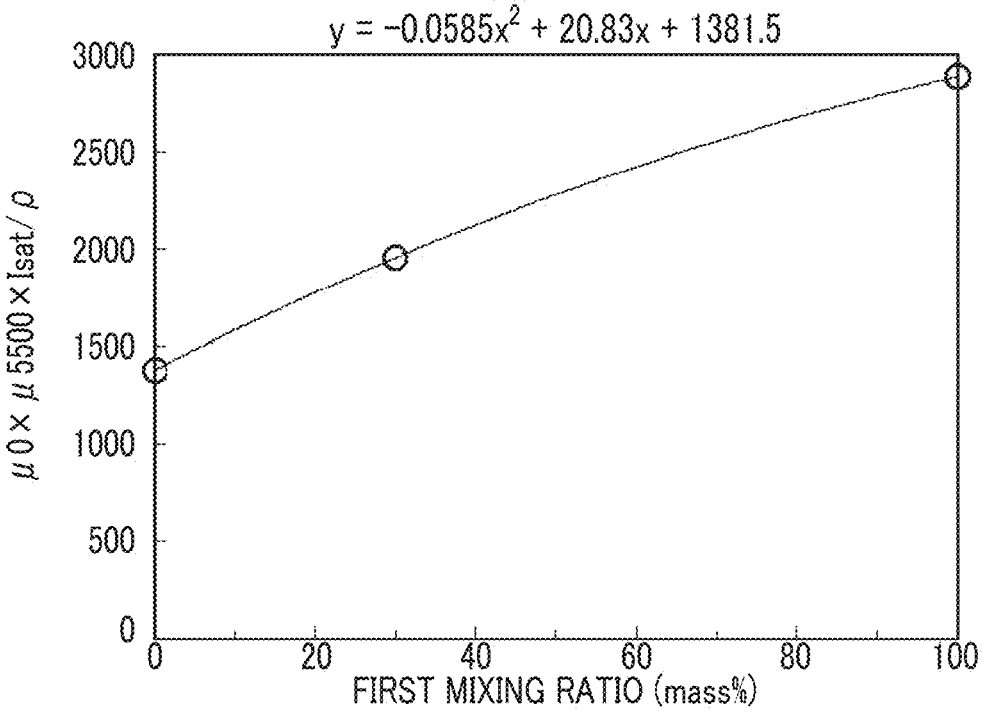
FIG. 19 is a graph showing the dependency of $\mu 0 \times \mu 5500 \times Isat/\rho$ on the first mixing ratio in Example 5.
Figure 20:
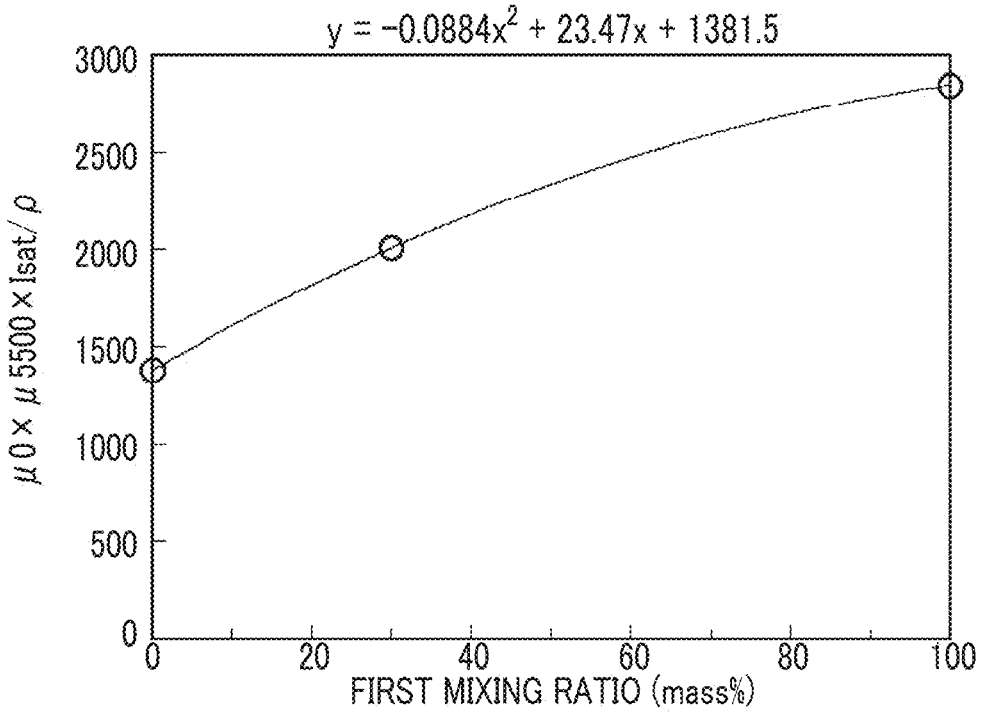
FIG. 20 is a graph showing the dependency of $\mu 0 \times \mu 5500 \times Isat/\rho$ on the first mixing ratio in Example 6.
Figure 21:
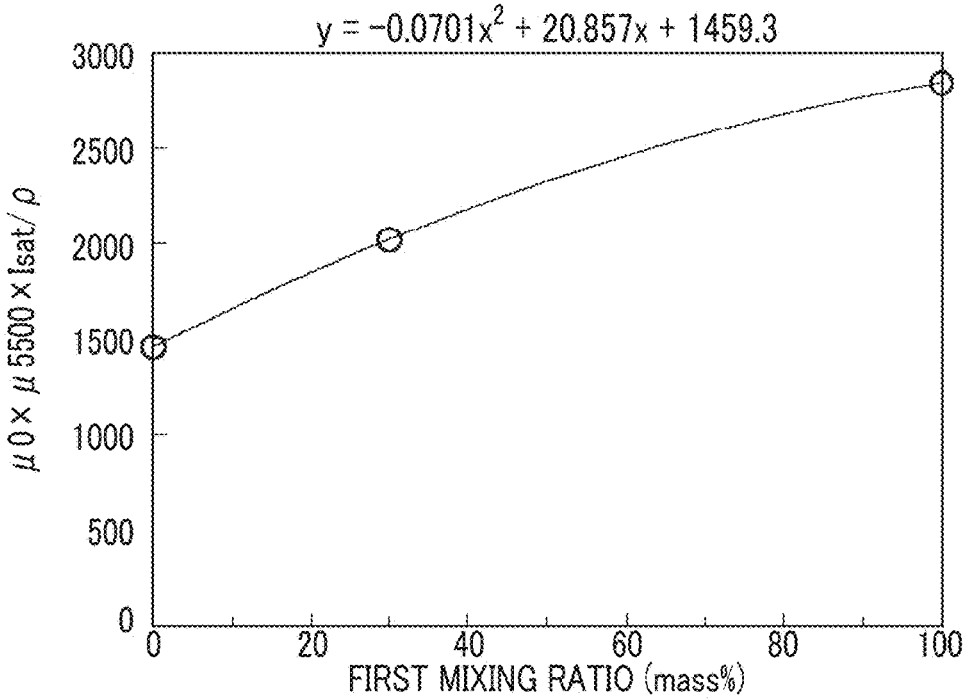
FIG. 21 is a graph showing the dependency of $\mu 0 \times \mu 5500 \times Isat/\rho$ on the first mixing ratio in Example 7.
Figure 22:
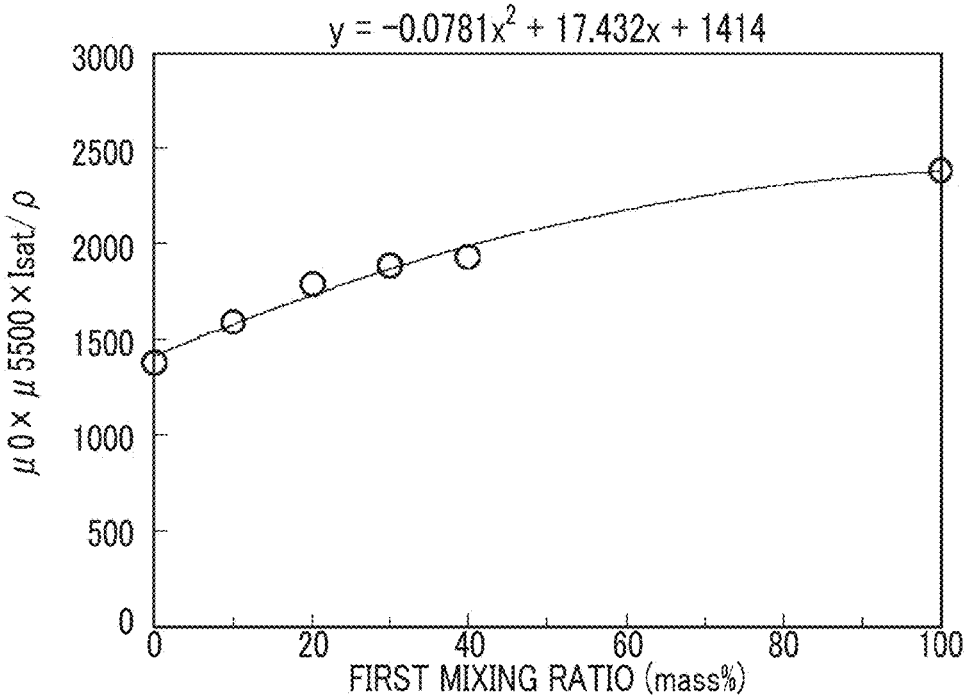
FIG. 22 is a graph showing the dependency of $\mu 0 \times \mu 5500 \times Isat/\rho$ on the first mixing ratio in Example 8.
Figure 23:
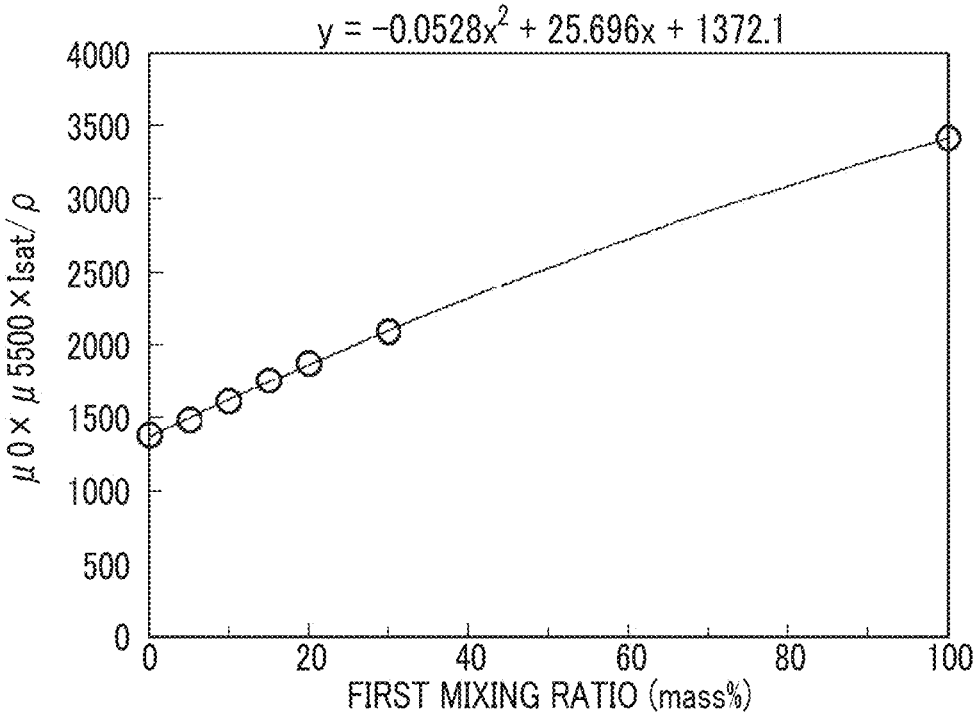
FIG. 23 is a graph showing the dependency of $\mu 0 \times \mu 5500 \times Isat/\rho$ on the first mixing ratio in Example 9.
Figure 24:
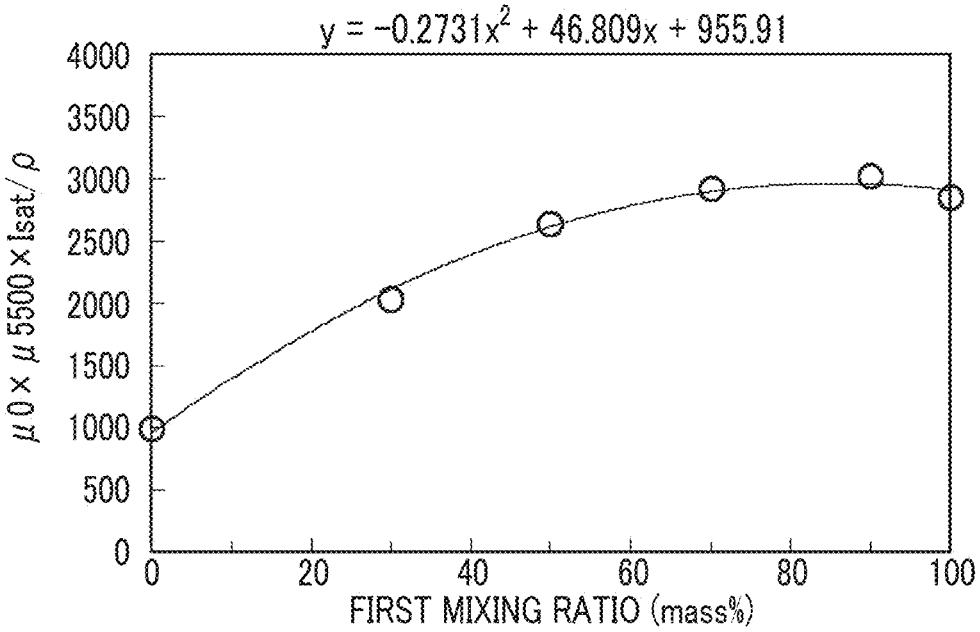
FIG. 24 is a graph showing the dependency of $\mu 0 \times \mu 5500 \times Isat/\rho$ on the first mixing ratio in Example 10.

FIG. 15 is a graph showing the dependency of μ0×μ5500×Isat/ρ on the first mixing ratio in Example 1. FIG. 16 is a graph showing the dependency of μ0×μ5500×Isat/ρ on the first mixing ratio in Example 2. FIG. 17 is a graph showing the dependency of ×μ5500×Isat/ρ on the first mixing ratio in Example 3. FIG. 18 is a graph showing the dependency of μ0×μ5500×Isat/ρ on the first mixing ratio in Example 4. FIG. 19 is a graph showing the dependency of μ0×μ5500×Isat/ρ on the first mixing ratio in Example 5. FIG. 20 is a graph showing the dependency of μ0×μ5500×Isat/ρ on the first mixing ratio in Example 6. FIG. 21 is a graph showing the dependency of μ0×μ5500×Isat/ρ on the first mixing ratio in Example 7. FIG. 22 is a graph showing the dependency of μ0×μ5500×Isat/ρ on the first mixing ratio in Example 8. FIG. 23 is a graph showing the dependency of μ0×μ5500×Isat/ρ on the first mixing ratio in Example 9. FIG. 24 is a graph showing the dependency of μ0×μ5500×Isat/ρ on the first mixing ratio in Example 10.

Figure 25:
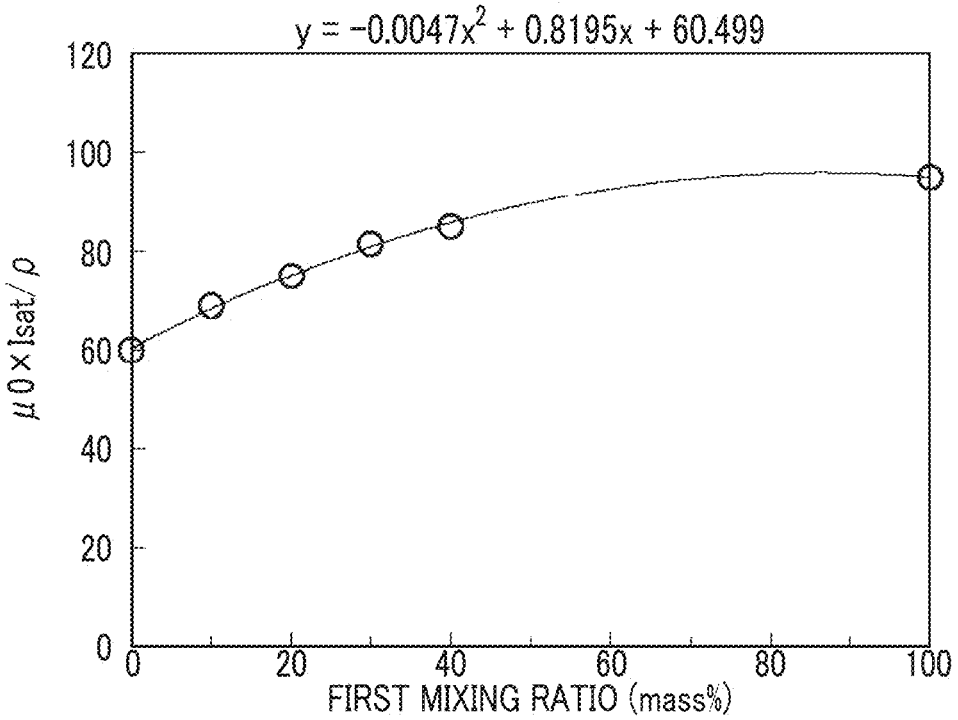
FIG. 25 is a graph showing the dependency of μ0×Isat/ρ on the first mixing ratio in Example 1.
Figure 26:
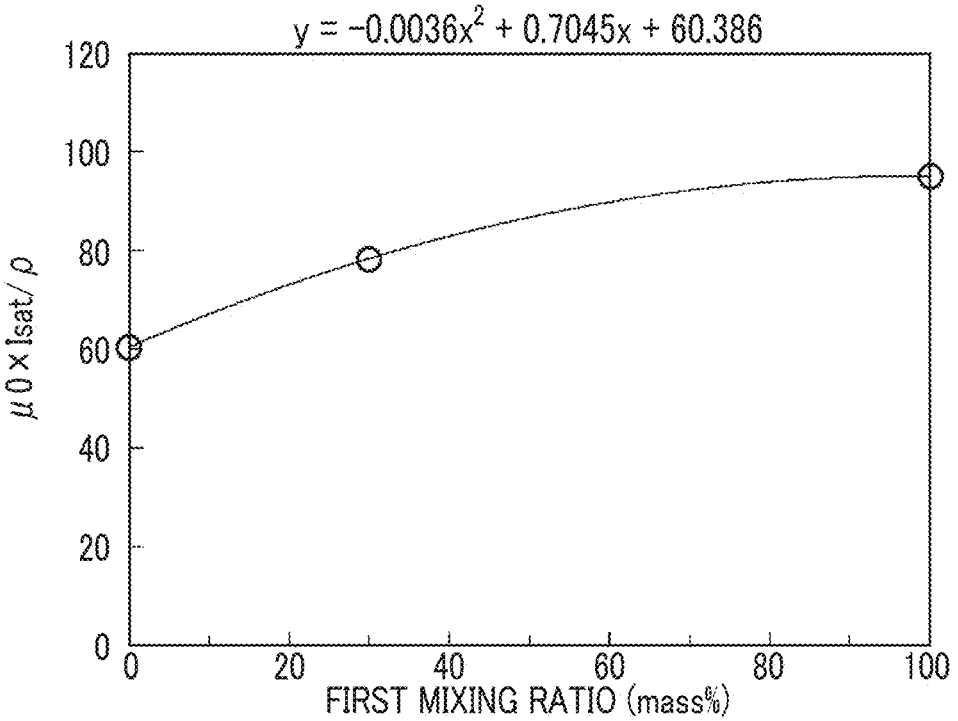
FIG. 26 is a graph showing the dependency of μ0×Isat/ρ on the first mixing ratio in Example 2.
Figure 27:
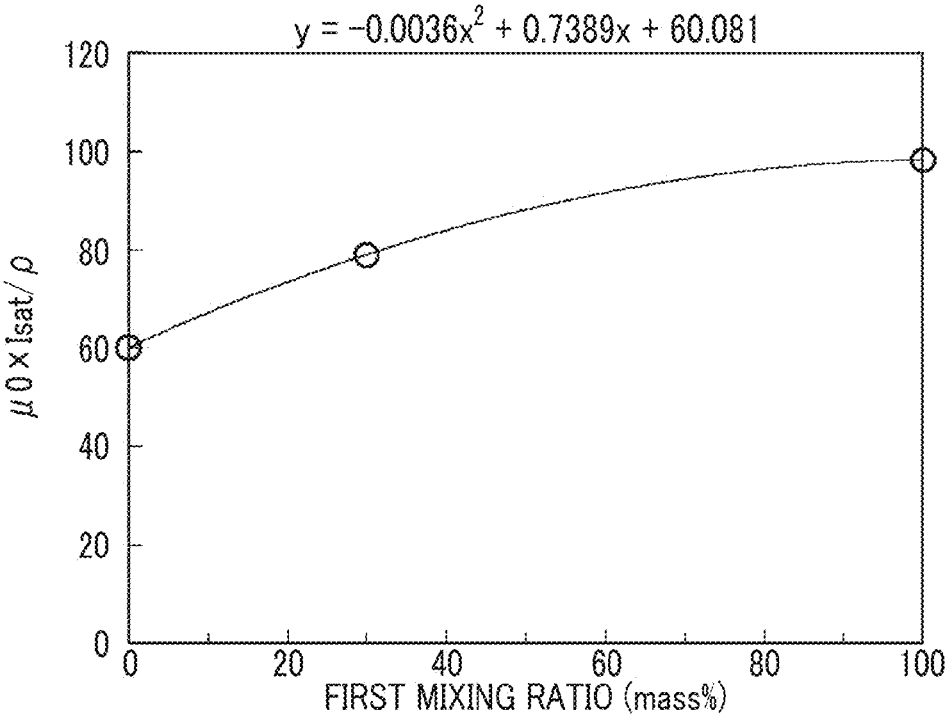
FIG. 27 is a graph showing the dependency of μ0×Isat/ρ on the first mixing ratio in Example 3.
Figure 28:
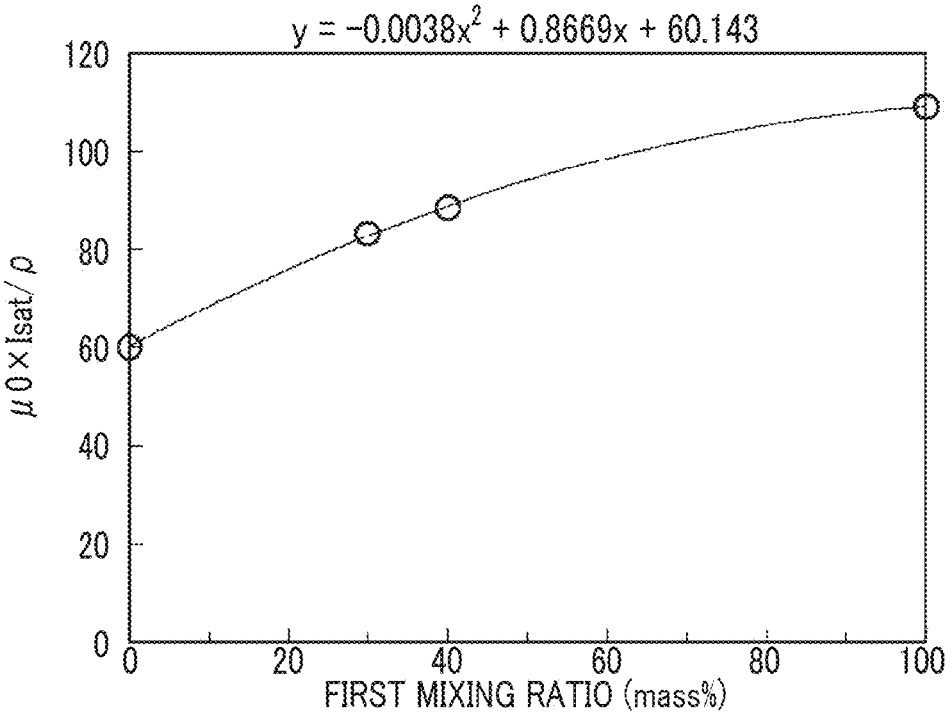
FIG. 28 is a graph showing the dependency of μ0×Isat/ρ on the first mixing ratio in Example 4.
Figure 29:
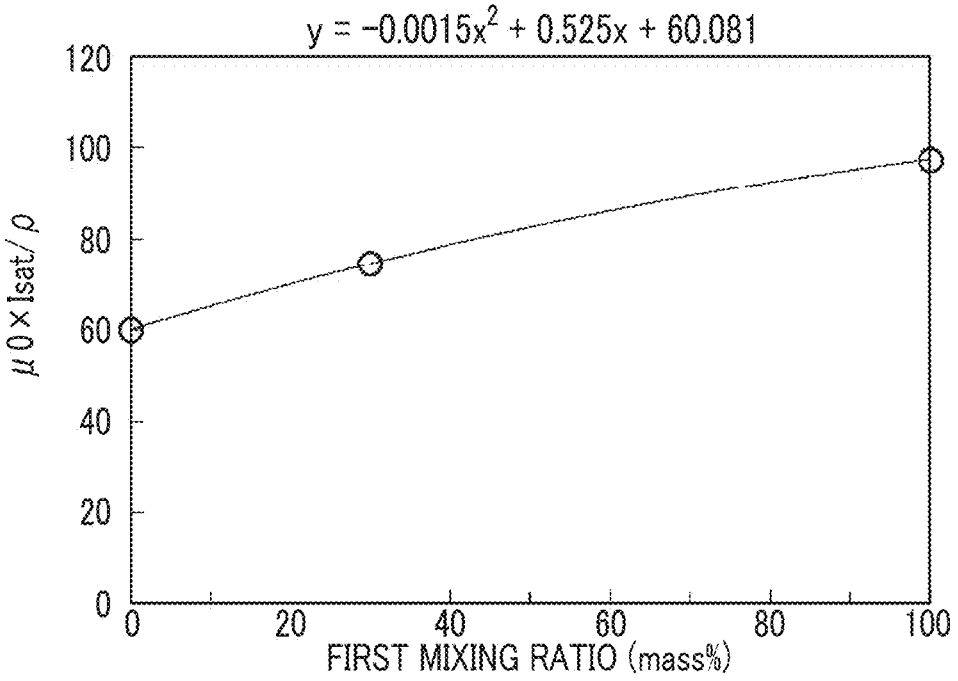
FIG. 29 is a graph showing the dependency of μ0×Isat/ρ on the first mixing ratio in Example 5.
Figure 30:
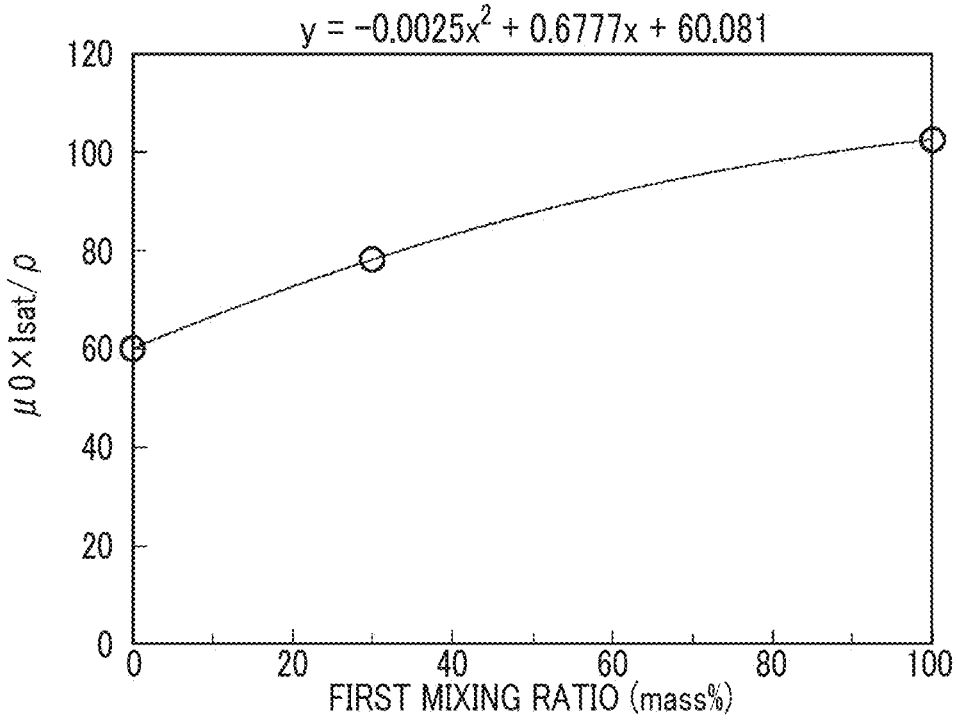
FIG. 30 is a graph showing the dependency of μ0×Isat/ρ on the first mixing ratio in Example 6.
Figure 31:
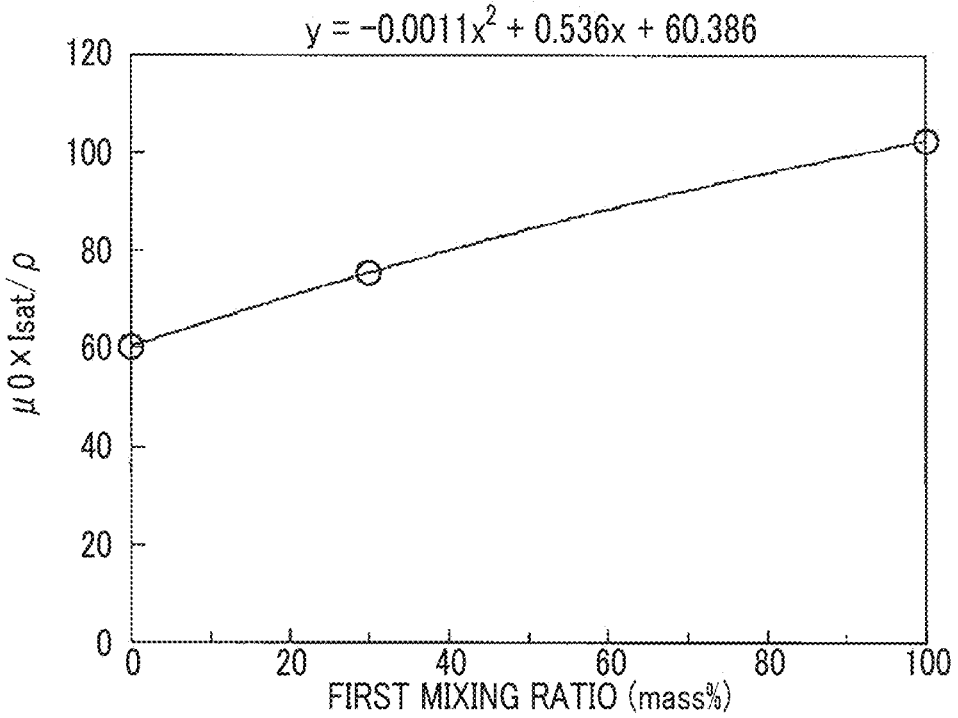
FIG. 31 is a graph showing the dependency of μ0×Isat/ρ on the first mixing ratio in Example 7.
Figure 32:
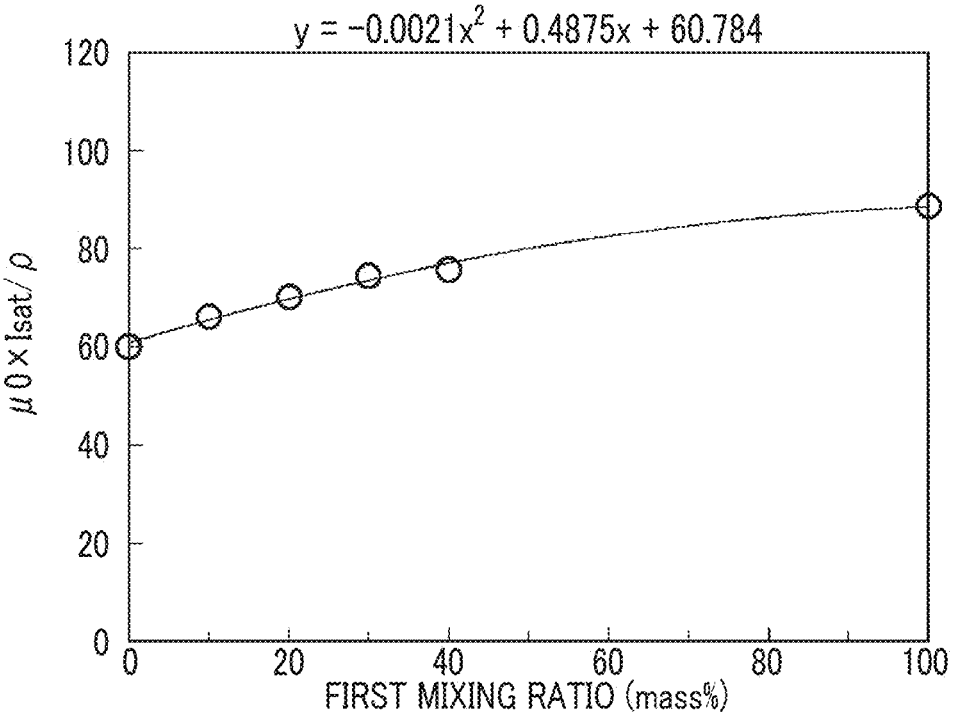
FIG. 32 is a graph showing the dependency of μ0×Isat/ρ on the first mixing ratio in Example 8.
Figure 33:
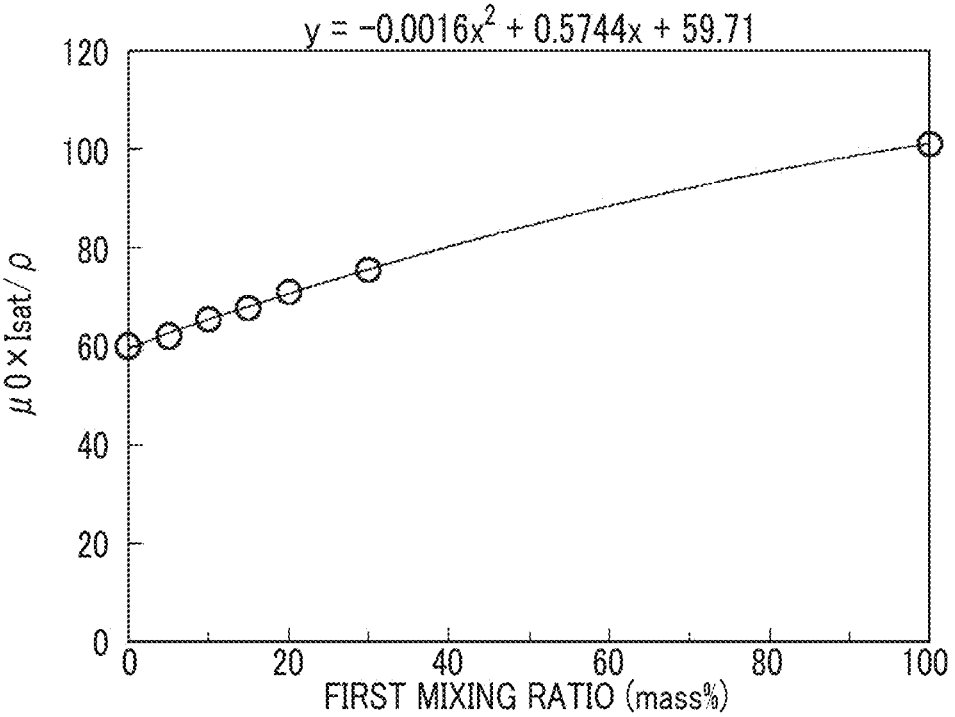
FIG. 33 is a graph showing the dependency of μ0×Isat/ρ on the first mixing ratio in Example 9.
Figure 34:
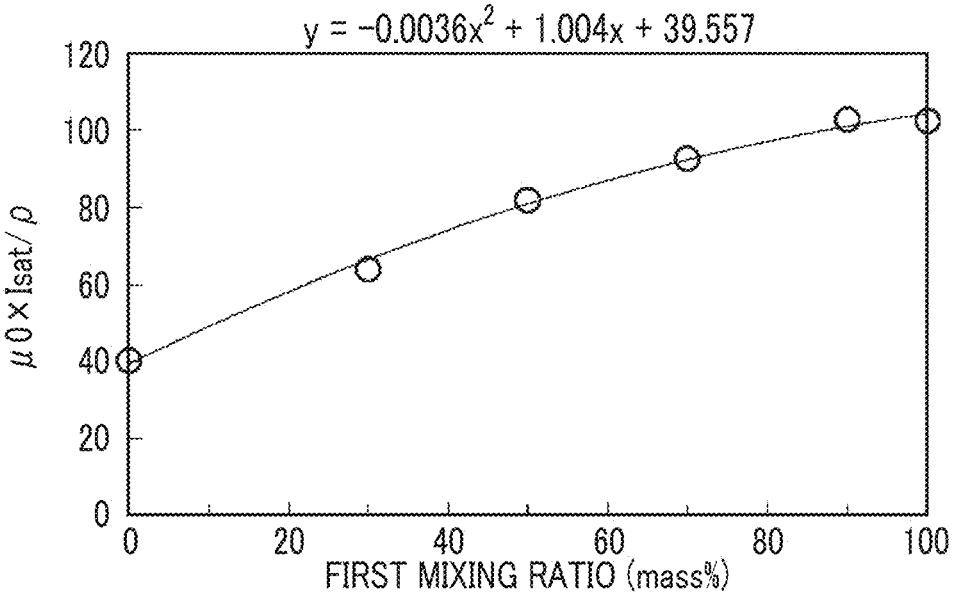
FIG. 34 is a graph showing the dependency of μ0×Isat/ρ on the first mixing ratio in Example 10.

FIG. 25 is a graph showing the dependency of μ0×Isat/ρ on the first mixing ratio in Example 1. FIG. 26 is a graph showing the dependency of μ0×Isat/ρ on the first mixing ratio in Example 2. FIG. 27 is a graph showing the dependency of μ0×Isat/ρ on the first mixing ratio in Example 3. FIG. 28 is a graph showing the dependency of μ0×Isat/ρ on the first mixing ratio in Example 4. FIG. 29 is a graph showing the dependency of μ0×Isat/ρ on the first mixing ratio in Example 5. FIG. 30 is a graph showing the dependency of μ0×Isat/ρ on the first mixing ratio in Example 6. FIG. 31 is a graph showing the dependency of μ0×Isat/ρ on the first mixing ratio in Example 7. FIG. 32 is a graph showing the dependency of μ0×Isat/ρ on the first mixing ratio in Example 8. FIG. 33 is a graph showing the dependency of μ0×Isat/ρ on the first mixing ratio in Example 9. FIG. 34 is a graph showing the dependency of μ0×Isat/ρ on the first mixing ratio in Example 10.

In each graph, fitting of a quadratic curve to the evaluation results is performed, and the quadratic curve obtained as a result is shown as a solid line in the graph. A function representing the quadratic curve (in the equation, x is the value of the first mixing ratio, and y is the value of Relative Pcv, the value of μ0×μ5500×Isat/ρ, or the value of μ0×Isat/ρ is written in the vicinity of the graph. By comparing the coefficients of x2, the nonlinearity of the curve can be relatively evaluated.

Regarding the results of Example 1, the relationship between the core loss Pcv and μ0×μ5500×Isat/ρ and the relationship between the core loss Pcv and μ0×Isat/ρ were plotted. The results are shown in FIGS. 35 and 36.

Figure 35:
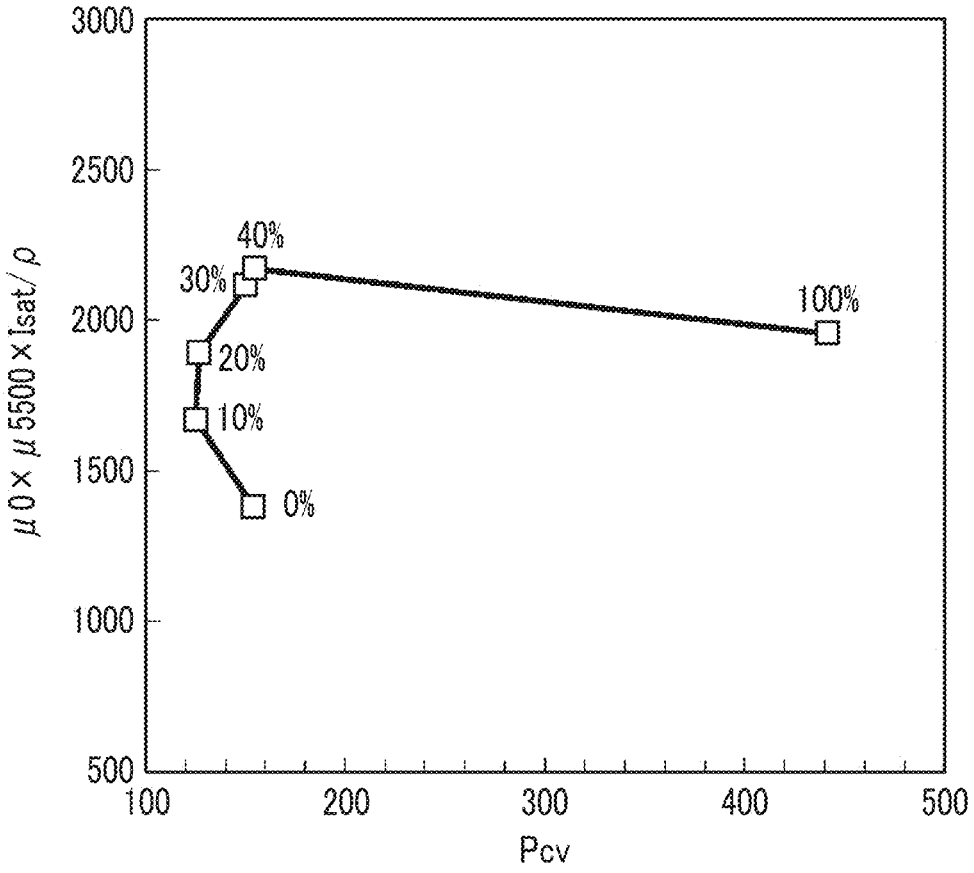
FIG. 35 is a graph showing the results of plotting the relationship between a core loss Pcv and μ0×μ5500×Isat/ρ regarding the results of Example 1.
Figure 36:
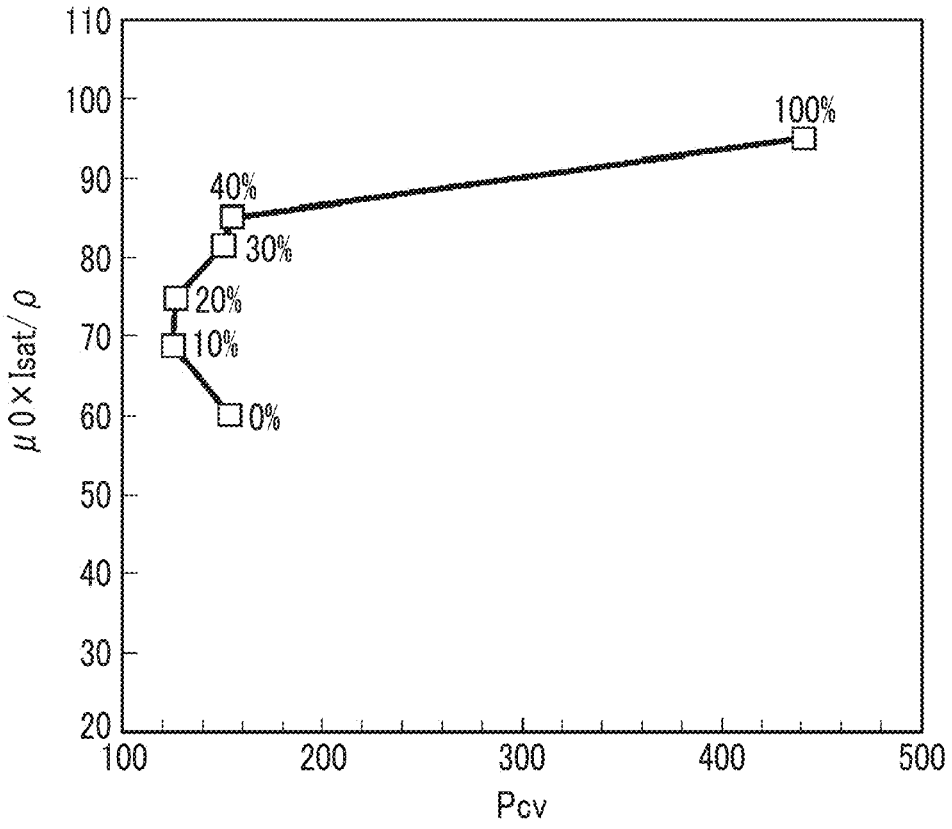
FIG. 36 is a graph showing the results of plotting the relationship between the core loss Pcv and μ0×Isat/ρ regarding the results of Example 1.

As shown in FIGS. 35 and 36, μ0×μ5500×Isat/ρ or μ0×Isat/ρ preferentially increased with an increase in the first mixing ratio until the first mixing ratio reached 40 mass %, and the core loss Pcv became equal to or lower than that in the case where the first mixing ratio was 0 mass %. Therefore, it was confirmed that the powder core produced in Example 1 is a powder core which provides an extremely good inductor having particularly excellent DC superposition characteristics and a particularly low core loss Pcv.

Regarding the results of Example 10, the relationship between the core loss Pcv and μ0×μ5500×Isat/ρ and the relationship between the core loss Pcv and μ0×Isat/ρ were plotted. The results are shown in FIGS. 39 and 40.

Figure 39:
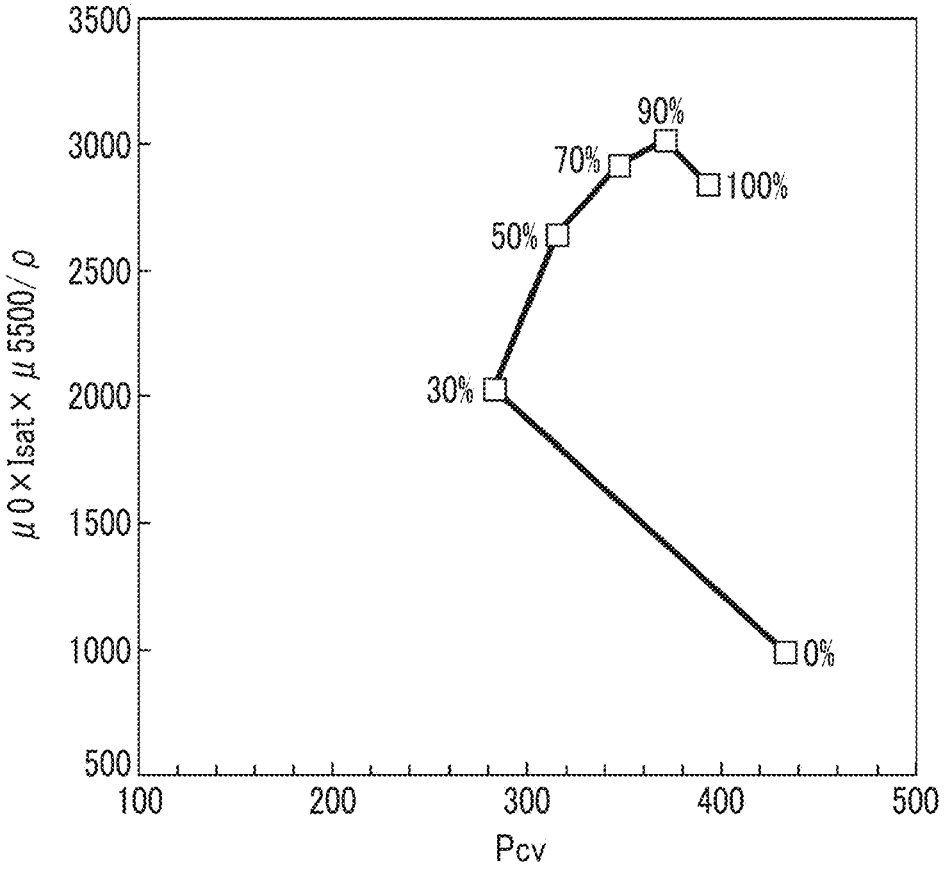
FIG. 39 is a graph showing the results of plotting the relationship between the core loss Pcv and μ0×μ5500×Isat/ρ regarding the results of Example 10.
Figure 40:
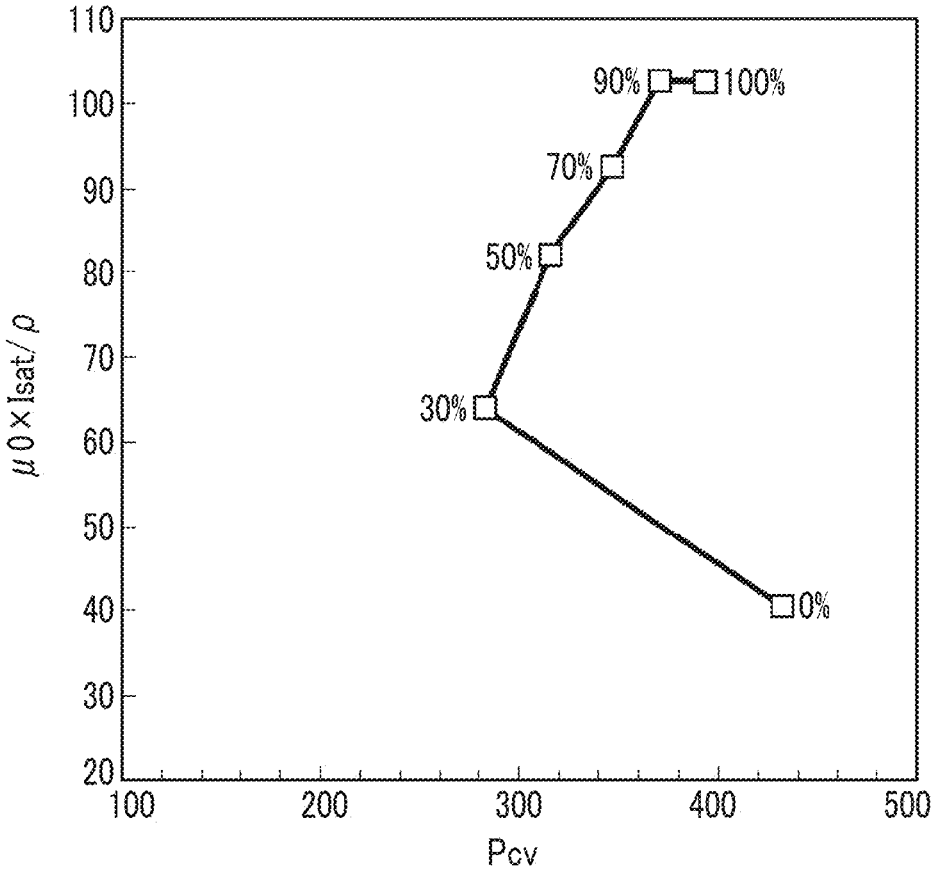
FIG. 40 is a graph showing the results of plotting the relationship between the core loss Pcv and μ0×Isat/ρ regarding the results of Example 10.

As shown in FIGS. 39 and 40, μ0×μ5500×Isat/ρ or μ0×Isat/ρ preferentially increased with an increase in the first mixing ratio until the first mixing ratio reached 30 mass %, and the core loss Pcv became equal to or lower than that in the case where the first mixing ratio was 0 mass %. However, the value of the core loss Pcv itself of the powder core produced in Example 10 became higher than that of the powder core produced in Example 1. It is thought that this is affected by a D50A/D50C of as high as 3.8.

From the viewpoint of comparing the results of Examples 1 to 8 and Example 10 in which the compositions of the crystalline magnetic materials are all Fe—Si—Cr alloys, the cases where the first mixing ratios in these examples are 30 mass % were picked up (Table 22), and the relationship between the core loss Pcv and μ0×μ5500×Isat/ρ and the relationship between the core loss Pcv and μ0×Isat/ρ were plotted. The results are shown in FIGS. 37 and 38.

TABLE 22

| | Pcv(kW/m3) at 2 MHz, 15 mT | μ0 × μ5500 × Isat/ρ | μ0 × Isat/ρ |
|---|---|---|---|
| Example 1-4 | 150 | 2115 | 81.5 |
| Example 2-2 | 159 | 2159 | 78.3 |
| Example 3-2 | 134 | 1928 | 79.0 |
| Example 4-2 | 167 | 2217 | 83.1 |
| Example 5-2 | 212 | 1954 | 74.5 |
| Example 6-2 | 189 | 2006 | 78.1 |
| Example 7-2 | 204 | 2022 | 75.4 |
| Example 8-4 | 195 | 1883 | 74.5 |
| Example 10-2 | 283 | 2031 | 64.0 |

Figure 37:
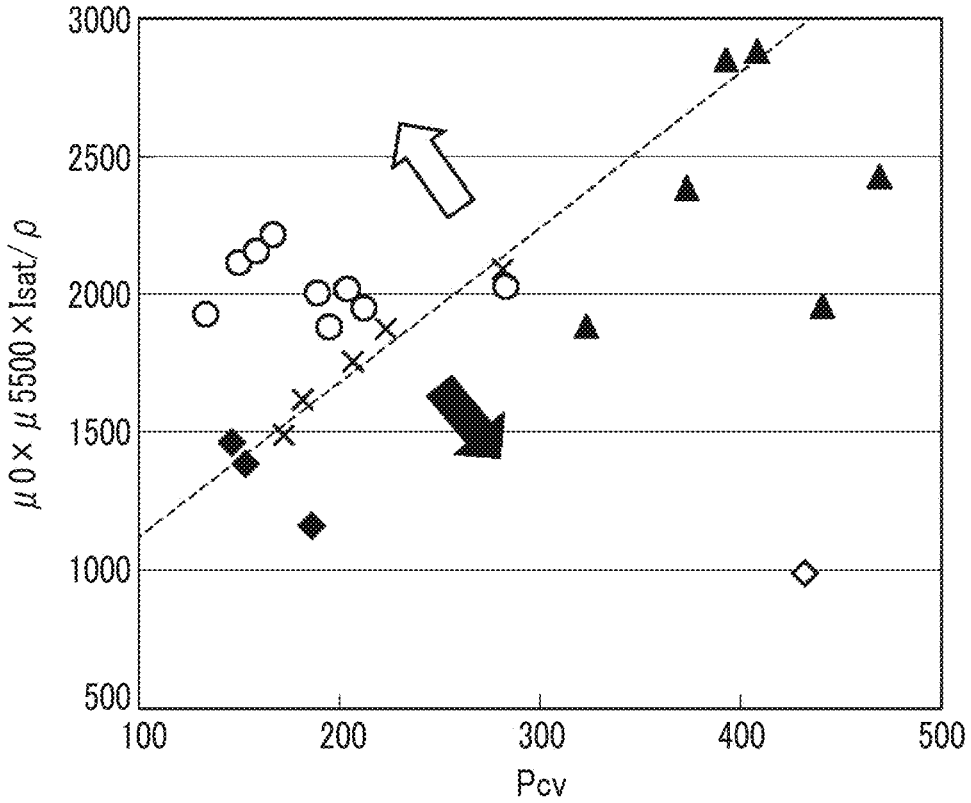
FIG. 37 is a graph showing the results of plotting the relationship between the core loss Pcv and μ0×μ5500×Isat/ρ by picking up a case where the first mixing ratios in each example are 30 mass % from the viewpoint of comparing the results of Examples 1 to 8 and Example 10.
Figure 38:
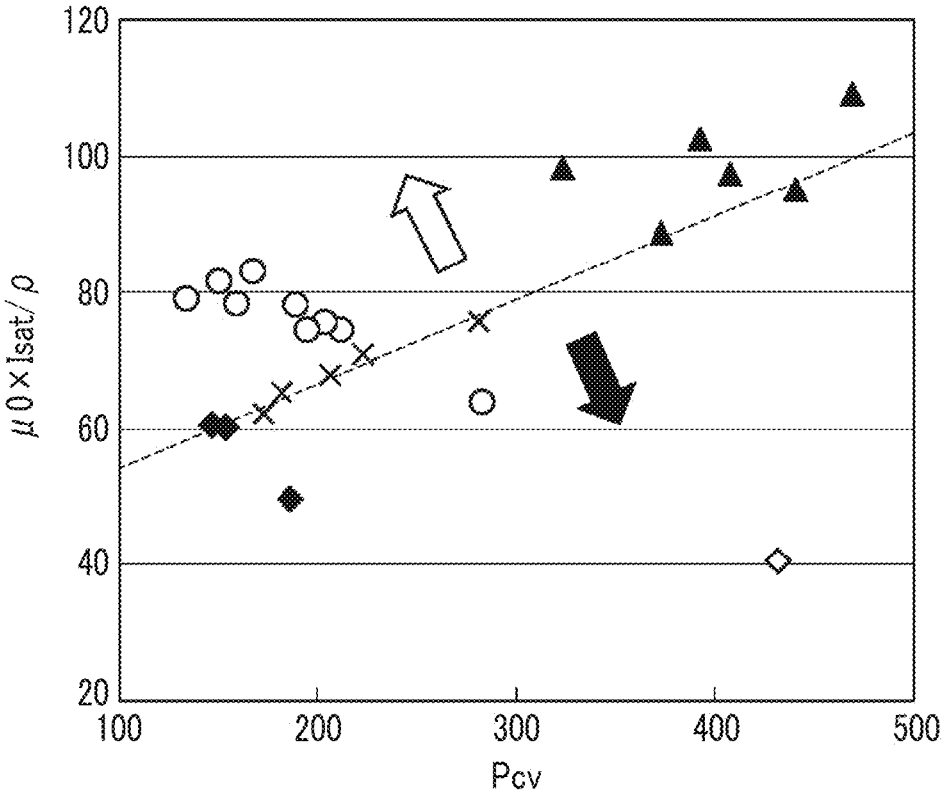
FIG. 38 is a graph showing the results of plotting the relationship between the core loss Pcv and μ0×Isat/ρ by picking up the case where the first mixing ratios in each example are 30 mass % from the viewpoint of comparing the results of Examples 1 to 8 and Example 10.

The description of the symbols in FIGS. 37 and 38 is as follows. The white circles (○) are the results in the cases where the first mixing ratio in each example is 30 mass %. The black rhombi (◆) are the results in the cases where the first mixing ratio in Examples 1 to 9 is 0 mass %. The white rhombus (◇) is the result in the case where the first mixing ratio in Example 10 is 0 mass %. The black triangles (▲) are the results in the cases where the first mixing ratio in each example is 100 mass %. The cross marks (x) are the results in the cases (Examples 9-2 to 9-6) where the crystalline magnetic material is carbonyl iron and the first mixing ratio is from 5 mass % to 30 mass %.

The broken line in FIGS. 37 and 38 is a line that roughly connects the result in the case where the first mixing ratio is 0 mass % and the result in the case where the first mixing ratio of 100 mass %, and a case where the results are positioned above the broken line or on the upper side of the broken line, preferably on the upper left side as indicated by the white arrow in each figure represents that powder cores which provided inductors having excellent DC superposition characteristics and reduced core losses more than expected based on the mixing ratio between the powder of the crystalline magnetic material and the powder of the amorphous magnetic material contained in the powder cores, that is, beyond merely additivity were obtained.

Contrary to this, a case where the results are positioned on the lower side of the broken line of FIGS. 37 and 38, particularly on the lower right side as indicated by the black arrow in each figure represents that powder cores which provided inductors having deteriorated DC superposition characteristics and increased core losses more than expected based on the mixing of the powder of the crystalline magnetic material and the powder of the amorphous magnetic material contained in the powder cores were obtained. As shown in FIGS. 37 and 38, the result of Example 10-2 is positioned on the lower right side of the broken line, and it cannot be said that the powder core produced in Example 10 is a powder core which provides an inductor having excellent DC superposition characteristics and a reduced core loss. It is thought that this is affected by a D50A/D50C value of as high as 3.8, like the results of FIGS. 39 and 40 described above.

Examples 11 and 12

Raw materials were weighed so as to achieve a composition of Fe71 at % Ni6 at % Cr2 at % P11 at % C8 at % B2 at %, and powders (amorphous powders) of five types of amorphous magnetic material having different particle size distributions were produced using a water atomization method. The particle size distributions of the powders of the obtained amorphous magnetic materials were measured as volume-based distributions using "Microtrac particle size distribution measuring apparatus MT3300EX" manufactured by Nikkiso Co., Ltd. The particle size (median diameter) D50A at 50% on a cumulative particle size distribution from the small particle size side in the volume-based particle size distribution was 10 μm. These amorphous powders and the amorphous powders having median diameters D50A of 5 μm, 7 μm, and 15 μm, which were used in Examples 2 to 10, were prepared.

In addition, powders of crystalline magnetic materials which were made of a Fe—Si—Cr alloy having a Si content of 3.5 mass % and a Cr content of 4.5 mass % and including Fe and unavoidable impurities as the remainder, were subjected to a treatment corresponding to the surface treatment type II (surface insulation treatment based on zinc phosphate) as the surface treatment, and had median diameters D50C of 4 μm and 6 μm were prepared as the materials for Example 11. Furthermore, a powder of a crystalline magnetic material which was made of a Fe—Si—Cr alloy (the above-described composition type A-1) having a Si content of 6.4 mass % and a Cr content of 3.1 mass % and including Fe and unavoidable impurities as the remainder, was not subjected to a surface treatment (corresponding to the above-described surface treatment type I), and had a median diameter D50C of 2 μm was prepared as the material for Example 12.

The powders of the amorphous magnetic materials and the powders of the crystalline magnetic materials were mixed to achieve a first mixing ratio of 30 mass % such that magnetic powders of Examples 11-1 to 11-5 and a magnetic powder of Example 12 shown in Table 23. The same tests and evaluations as those in Examples 2 to 10 were conducted on these magnetic powders. The results are shown in Table 23.

TABLE 23

| | D50A (μm) | D50C (μm) | D50A/D50C | Core density ρ (g/cc) | μ (100 kHz) | Isat(A) ΔL/L = 30% | μ5500 (100 kHz) | Pcv (kW/m3) at 2 MHz, 15 mT | μ0x μ5500 xIsat/ρ | μ0x Isat/ρ |
|---|---|---|---|---|---|---|---|---|---|---|
| Example 11-1 | 5 | 6 | 0.83 | 5.708 | 30.36 | 13.6 | 26.40 | 241 | 1910 | 72.3 |
| Example 11-2 | 5 | 4 | 1.25 | 5.722 | 29.03 | 15.4 | 25.67 | 189 | 2006 | 78.1 |
| Example 11-3 | 7 | 4 | 1.75 | 5.748 | 31.42 | 13.8 | 26.80 | 204 | 2022 | 75.4 |
| Example 11-4 | 10 | 4 | 2.50 | 5.850 | 36.91 | 11.0 | 29.77 | 219 | 2066 | 69.4 |
| Example 11-5 | 15 | 4 | 3.75 | 5.909 | 44.49 | 8.5 | 31.73 | 283 | 2031 | 64.0 |
| Example 12 | 7 | 2 | 3.50 | 5.742 | 32.58 | 13.8 | 27.57 | 159 | 2159 | 78.3 |

Figure 41:
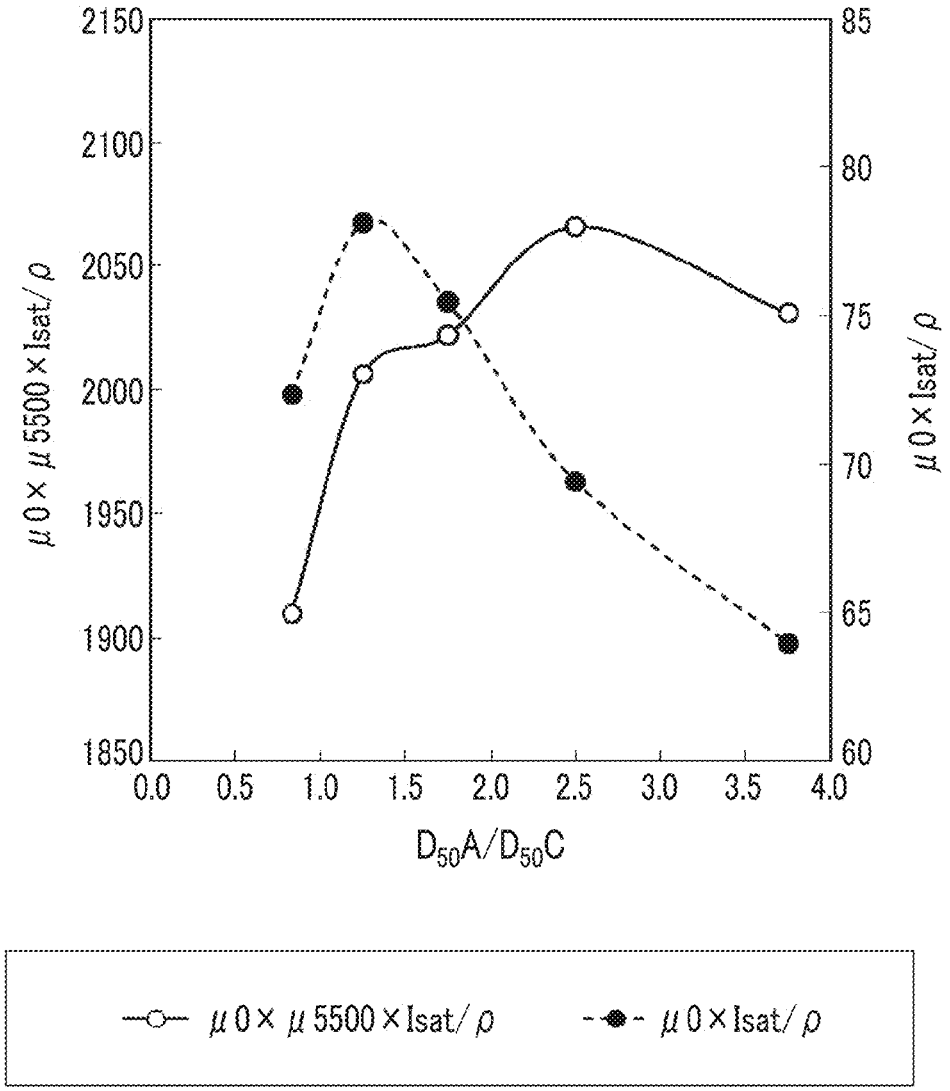
FIG. 41 is a graph showing the relationship between μ0×μ5500×Isat/ρ and D50A/D50C, and the relationship between μ0×Isat/ρ and D50A/D50C created based on the results of Example 11.

Based on the results of Example 11 shown in Table 23, the relationship between μ0×μ5500×Isat/ρ and D50A/D50C, and the relationship between μ0×Isat/ρ and D50A/D50C were plotted as a graph in FIG. 41. As shown in FIG. 41, when D50A/D50C is 1 or more and 3.5 or less, results that μ0×μ5500×Isat/ρ and μ0×Isat/ρ are improved can be obtained, and this tendency becomes significant in a case where D50A/D50C is 1.2 or more and 2.5 or less.

According to the embodiment of the present invention, a powder core which provides a good inductor having excellent DC superposition characteristics and a reduced core loss is obtained, and it was confirmed by the examples that the degree of goodness is a degree that exceeds the expectation based on the mixing ratio between a powder of a crystalline magnetic material and a powder of an amorphous magnetic material contained in the powder core.

The inductor including the powder core according to the present invention can be appropriately used as a component of a booster circuit of a hybrid vehicle or the like, a component of power generation and substation facilities, a component of a transformer or a choke coil, and the like.

It should be understood by those skilled in the art that various modifications, combinations, sub-combinations and alterations may occur depending on design requirements and other factors insofar as they are within the scope of the appended claims of the equivalents thereof.

What is claimed is:

1. A powder core comprising:

an amorphous magnetic material powder having a first median diameter D50A equal to or less than 7 μm; and a crystalline magnetic material powder having a second median diameter D50C, wherein the first median diameter D50A and the second median diameter D50C satisfy:

$$1 \leq D50A/D50C \leq 3.5,$$

and wherein a first mixing ratio which is a mass ratio of the crystalline magnetic material powder content of the powder core to a sum of the crystalline magnetic material powder content and the amorphous magnetic material powder content in the powder core is equal to or greater than 20 mass % and equal to or smaller than 40 mass %.

2. The powder core according to claim 1, wherein the first median diameter D50A and the second median diameter D50C satisfy:

$$1.2 \leq D50A/D50C \leq 2.5.$$

3. The powder core according to claim 1, wherein the crystalline magnetic material contains one material or two or more materials selected from the group consisting of a Fe—Si—Cr alloy, a Fe—Ni alloy, a Fe—Co alloy, a Fe—V alloy, a Fe—Al alloy, a Fe—Si alloy, a Fe—Si—Al alloy, carbonyl iron, and pure iron.

4. The powder core according to claim 3, wherein the crystalline magnetic material is made of the Fe—Si—Cr alloy.

5. The powder core according to claim 1, wherein the amorphous magnetic material contains one material or two or more materials selected from the group consisting of a Fe—Si—B alloy, a Fe—P—C alloy, and a Co—Fe—Si—B alloy.

6. The powder core according to claim 5, wherein the amorphous magnetic material is made of the Fe—P—C alloy.

7. The powder core according to claim 1, wherein the crystalline magnetic material powder has surfaces subjected to an insulation treatment.

8. The powder core according to claim 1, further comprising:

a binding component which binds the crystalline magnetic material powder and the amorphous magnetic material powder to other materials contained in the powder core.

9. The powder core according to claim 8, wherein the binding component contains a resin-based material.

10. A method for manufacturing the powder core according to claim 9, comprising:

obtaining a molded product by a molding treatment including pressure molding a mixture containing the crystalline magnetic material powder, the amorphous magnetic material powder, and the binding component containing the resin-based material.

11. The method according to claim 10, wherein the molded product is the powder core.

12. The method according to claim 10, further comprising:

performing a heat treatment of heating the molded product, thereby obtaining the powder core.

13. An inductor comprising:

the powder core according to claim 1;

a coil configured to generate an induced magnetic field by a current flowing therethrough; and connection terminals connected to respective ends of the coil so as to supply the current to the coil, wherein the powder core is disposed such that at least a part of the powder core is positioned in the induced magnetic field generated by the current flowing through the coil.

* * * * *